US008141250B2

(12) United States Patent
Tanaka et al.

(10) Patent No.: US 8,141,250 B2
(45) Date of Patent: Mar. 27, 2012

(54) METHOD OF MANUFACTURING A DROPLET DISCHARGING HEAD

(75) Inventors: Kumiko Tanaka, Kanagawa (JP); Michiaki Murata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 212 days.

(21) Appl. No.: 12/545,925

(22) Filed: Aug. 24, 2009

(65) Prior Publication Data

US 2009/0307905 A1 Dec. 17, 2009

Related U.S. Application Data

(62) Division of application No. 11/444,678, filed on Jun. 1, 2006, now Pat. No. 7,607,761.

(30) Foreign Application Priority Data

Dec. 27, 2005 (JP) ..... 2005-374319

(51) Int. Cl.
*B21D 53/76* (2006.01)
*B41J 2/045* (2006.01)

(52) U.S. Cl. ..... 29/890.1; 29/25.35; 29/830; 29/831; 29/832; 29/852; 347/68

(58) Field of Classification Search ..... 29/890.1, 29/25.35, 832, 830, 831, 852; 347/65, 68–70, 347/71, 72
See application file for complete search history.

(56) References Cited

U.S. PATENT DOCUMENTS 4,894,664 A * 1/1990 Tsung Pan ..... 347/63
4,922,265 A * 5/1990 Pan ..... 347/47
6,758,552 B1 7/2004 Figueredo
2003/0085960 A1* 5/2003 Kim et al. ..... 347/65
2006/0092239 A1* 5/2006 Sung et al. ..... 347/71

FOREIGN PATENT DOCUMENTS

| | | |
|---|---|---|
| EP | 0244643 | 11/1987 |
| JP | 61-003758 | 1/1986 |
| JP | 01-295857 | 11/1989 |
| JP | 02-165962 | 6/1990 |
| JP | 05-016353 | 1/1993 |
| JP | 06-238896 | 8/1994 |
| JP | 6-305141 | 11/1994 |
| JP | 09-174844 | 7/1997 |
| JP | 11-216860 | 8/1999 |
| JP | 2002033358 | 1/2002 |
| KR | 0374600 | 3/2003 |

OTHER PUBLICATIONS

Machine translation of JP 61-003758.
Machine translation of JP 2002033358.
Japanese Office Action A.N. 2005-374319; dated Nov. 29, 2011.
English translation of Japanese Office Action a.N. 2005-374319; dated Nov. 29, 2011.

* cited by examiner

*Primary Examiner* — Derris Banks
*Assistant Examiner* — Tai Nguyen
(74) *Attorney, Agent, or Firm* — Fildes & Outland, P.C.

(57) ABSTRACT

A droplet discharging head comprises a pressure chamber in which fluid is filled through a channel, and a nozzle that is connected to the pressure chamber and which discharges the fluid as a droplet. After the droplet discharging head is assembled, at least the wall surfaces contacting the fluid are coated with a carbonized silicon film.

3 Claims, 35 Drawing Sheets

A-A' CROSS-SECTIONAL SURFACE

B-B' CROSS-SECTIONAL SURFACE

C-C' CROSS-SECTIONAL SURFACE

FIG.14A

CONTACT ANGLES (DEGREES) BETWEEN INNER SURFACE COATING FILM (SiC FILM) AND EACH COMPONENT

| | Si | NICKEL | PHOTOSEN. GLASS | SUS | PI ADHESIVE | SiC FILM |
|---|---|---|---|---|---|---|
| $H_2O$ | 63.6 | 82.0 | 82.9 | 78.0 | 88.5 | 61.2 |

FIG.14B

CHANGES IN CONTACT ANGLES WITH SiC FILM PRIOR TO AND AFTER FLUID CONTACT TEST (° )

| CONTACT FLUID: INK | NOTES | | PRIOR TO CONTACT WITH FLUID | AFTER CONTACT WITH FLUID | AMOUNT OF CHANGE |
|---|---|---|---|---|---|
| ACIDIC FLUID | ORGANIC CARBON ACID SOLUTION | pH=3.7 | 64.8 | 65.3 | 0.50 |
| BASE FLUID | pH ADJUSTMENT W/GOOD BUFFERING AGENT (CHES) AND NaOH | pH=9.5 | 64.4 | 63.5 | −0.90 |
| UV MONOMER | | | 68.0 | 65.9 | −2.10 |

MEASUREMENT ENVIRONMENT
MEASURED AT ROOM TEMP: 24°C, HUMIDITY 60%

METHOD OF MANUFACTURING A DROPLET DISCHARGING HEAD

CROSS-REFERENCE TO RELATED APPLICATION

This application is a division of U.S. application Ser. No. 11/444,678 filed Jun. 1, 2006, which claims priority under 35 USC 119 from Japanese Patent Application, No. 2005-374319, the disclosure of which is incorporated by reference herein.

BACKGROUND OF THE INVENTION

1. Technical Field

The present invention relates to a droplet discharging head comprising: a pressure chamber in which a fluid such as ink is filled through a channel; and nozzles that are connected to the pressure chamber and which discharge the fluid as droplets. The present invention also relates to a manufacturing method for such a head, and to a droplet discharging device provided with this droplet discharging head.

2. Related Art

Inkjet recording devices (i.e., droplet discharging devices) that have inkjet recording heads that are an example of a type of droplet discharging head are conventionally known. With the inkjet recording device, ink droplets are selectively discharged from multiple nozzles in the inkjet recording head, and images (including text characters and the like) are printed on a printing medium such as recording paper. One of the necessary and indispensable conditions in manufacturing the inkjet recording heads in the inkjet recording device is the selection of components exhibiting resistance to ink.

For example, there is an inkjet recording head that has multiple plates comprising each structure from the ink supply route to the nozzles layered therein. This is a multi-nozzle type head where multiple ink discharging mechanisms (i.e., ejectors) are connected. With this type of inkjet recording head, the plates that comprise each of the structures are formed from many differing components. Moreover, in connecting each of the plates, many joining components (i.e., adhesives) are used. The ink resistance of the structural components of each layer and of the adhesives is an issue.

In other words, when materials that are best suited to the functions of the components comprising each of the mechanisms inside the inkjet recording head are used, there are cases where many different types of materials are used for each of the structural components. When this is the case, it is difficult both in terms of efficient production and materials selection to achieve the ink resistance of each of the structural components while maintaining the materials best suited to each function.

For this reason, there have been proposals to coat, for example, resin layers containing inorganic particles on each of the structural components and the adhesive in order to improve resistance to ink. With an inkjet recording head that has multiple plates of different materials from the ink supply route to the nozzles layered therein, there is still much room for improving the ink resistance of each of the structural components and the adhesives.

SUMMARY

A droplet discharging head according to one embodiment of the present invention comprises; a pressure chamber in which fluid is filled through a channel, and nozzles that are connected to the pressure chamber and which discharge the fluid as droplets. The wall surfaces that contact the fluid are coated with a carbonized silicon film (hereafter, sometimes referred to as "SiC film").

Further, one embodiment of the present invention is a method of manufacturing a droplet discharging head comprising; a pressure chamber in which fluid is filled through a channel, and nozzles that are connected to the pressure chamber and which discharge the fluid as droplets. In this method, at least wall surfaces that contact the fluid are coated with a carbonized silicon film using a chemical vapor growth method.

Further, one embodiment of the present invention is a method of manufacturing a droplet discharging head comprising a pressure chamber in which fluid is filled through a channel, nozzles that are connected to the pressure chamber and which discharge the fluid as droplets, a vibration plate that comprises a portion of the pressure chamber, and a piezoelectric element that displaces the vibration plate. Prior to joining a channel substrate, in which the pressure chamber and nozzles are formed, to a piezoelectric element substrate provided with the vibration plate and piezoelectric elements, the piezoelectric element substrate and the channel substrate are coated with a carbonized silicon film using a chemical vapor growth method.

Further, a droplet discharging device according to one embodiment of the present invention is provided with a droplet discharging head that comprises, a pressure chamber in which fluid is filled through a channel; and nozzles that are connected to the pressure chamber and which discharge the fluid as droplets. The wall surfaces of the droplet discharging head provided in this device that contact the fluid are coated with a carbonized silicon film.

BRIEF DESCRIPTION OF THE DRAWINGS

Embodiments of the present invention will be described in detail based on the following figures, wherein:

FIG. 14A is a chart comparing the contact angles of the SiC film with other components using purified water, and FIG. 14B is a chart comparing the amount of change in contact angles of the SiC film after contact with purified water;

DESCRIPTION

Figure 1:
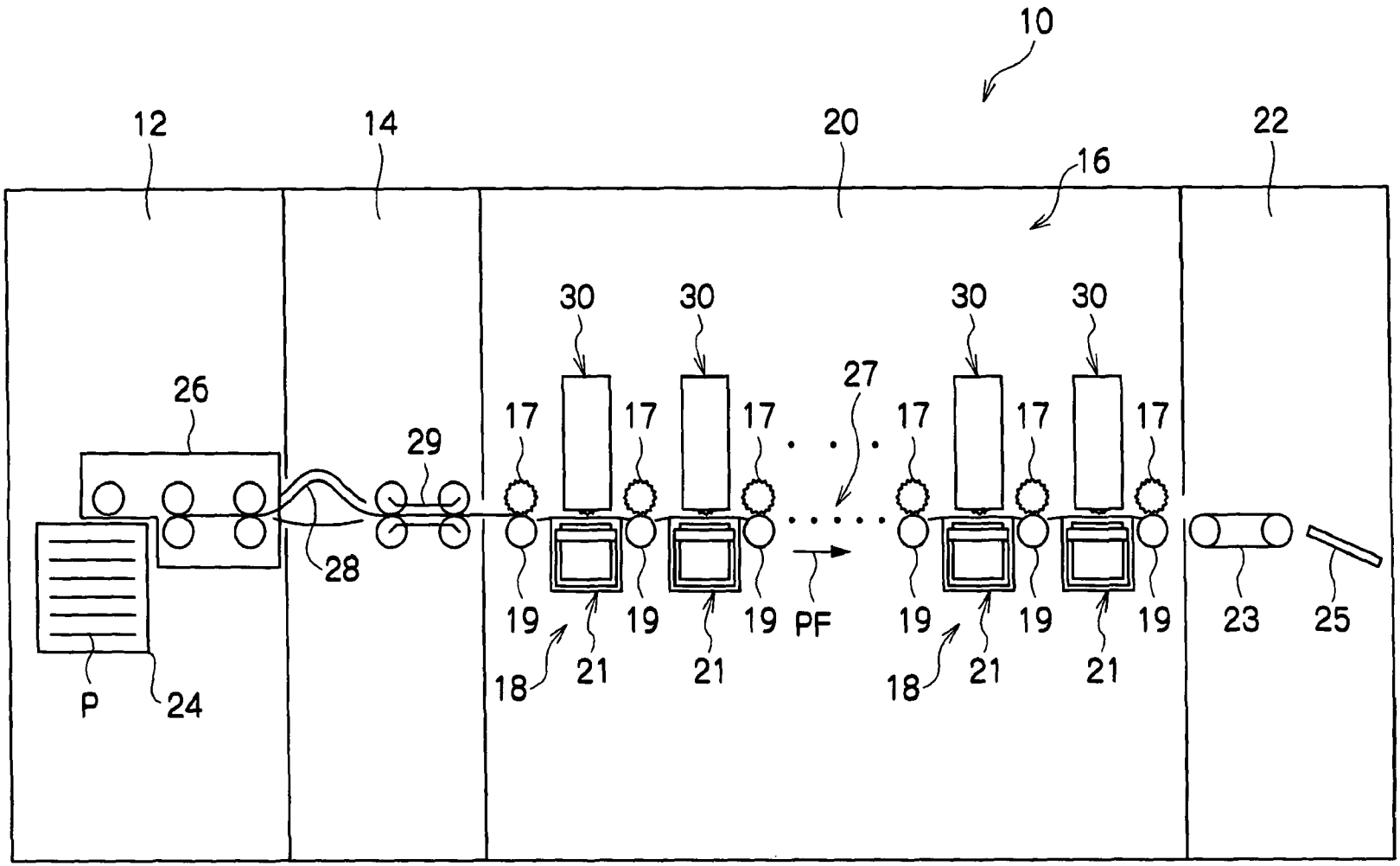
FIG. 1 is an outline frontal drawing showing an inkjet recording device.

The embodiments of the present invention will be explained in detail based on the examples shown in the drawings. Explanations will be made using an inkjet recording device 10 as an example of the droplet discharging device. The explanations will be made where the fluid is an ink 110 and the droplet discharging head an inkjet recording head 32. Further, the recording medium is a recording paper P.

As shown in FIG. 1, an inkjet recording device 10 basically comprises a paper-supplying unit 12 that sends out recording paper P; a receiving adjustment unit 14 that controls the approach of the recording paper P; a recording unit 20 provided with a recording head unit 16 that discharges ink droplets and forms an image on the recording paper P and a maintenance unit 18 that performs maintenance of the recording head unit 16; and a discharging unit 22 that discharges the recording paper P on which an image was formed at the recording unit 20.

The paper-supplying unit 12 comprises a stocker 24 in which stacked recording paper P is stocked and a conveying device 26 that sheet-feeds paper from the stocker 24 one sheet at a time and conveys it to the receiving adjustment unit 14. The receiving adjustment unit 14 is provided with a loop-forming unit 28 and a guide component 29 that controls the approach of the recording paper P. By passing through this portion, the body of the recording paper P is used to correct skew, the conveying timing is controlled, and the paper is supplied to the recording unit 20. Then the discharging unit 22 passes the recording paper P on which an image was formed at the recording unit 20 through a paper-discharging belt 23 and stores it in a tray 25.

A paper-conveying route 27 on which the recording paper P is conveyed is formed between the recording head unit 16 and maintenance unit 18. The paper-conveying route 27 has star wheels 17 and conveying rollers 19. The recording paper P is continuously sandwiched and held (without stopping) by the star wheels 17 and conveying rollers 19. Ink droplets are then discharged from the recording head unit 16 onto this recording paper P and an image is formed on the recording paper P.

The maintenance unit 18 comprises a maintenance device 21 arranged opposite an inkjet recording unit 30, and the maintenance unit 18 can perform processing for the inkjet recording heads 32 (to be described later) such as capping and wiping, and even dummy jet and vacuum processing.

Figure 2:
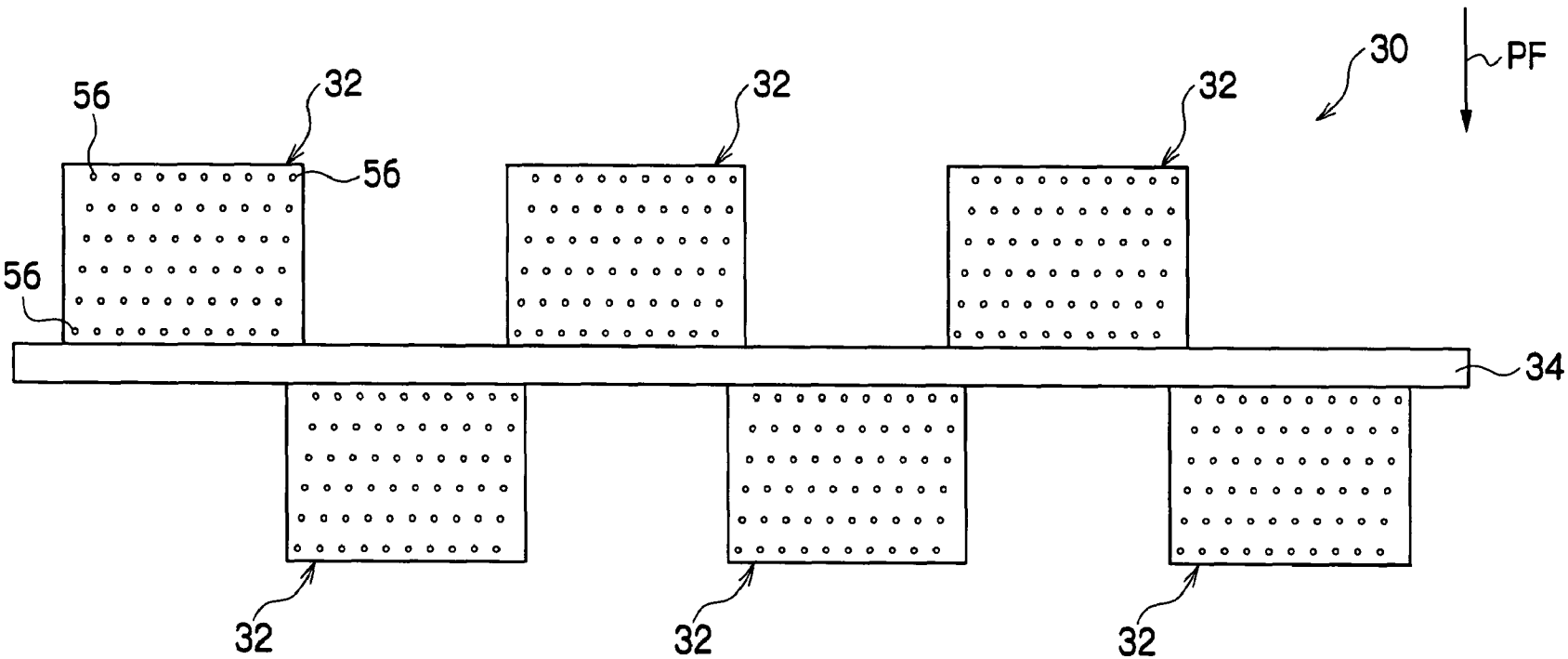
FIG. 2 is an explanatory drawing showing the arrangement of the inkjet recording heads.

As shown in FIG. 2, each inkjet recording unit 30 is provided with a support component 34 arranged in a direction perpendicular to the direction in which the paper is conveyed, which is indicated with the PF arrow. Multiple inkjet recording heads 32 are attached to this support component 34. Multiple nozzles 56 are formed in a matrix pattern in the inkjet recording heads 32. The nozzles 56 are arranged in lines at a constant pitch as an entire unit in the inkjet recording unit 30 in the widthwise direction of the recording paper P.

An image is recorded on the recording paper P by discharging ink droplets from the nozzles 56 onto the recording paper P, which is conveyed continuously along the paper-conveying route 27. It should be noted that when recording, for example, so-called full-color images, the inkjet recording unit 30 has at least four colors arranged therein corresponding to each color of yellow (Y), magenta (M), cyan (C), and black (K).

Figure 3:
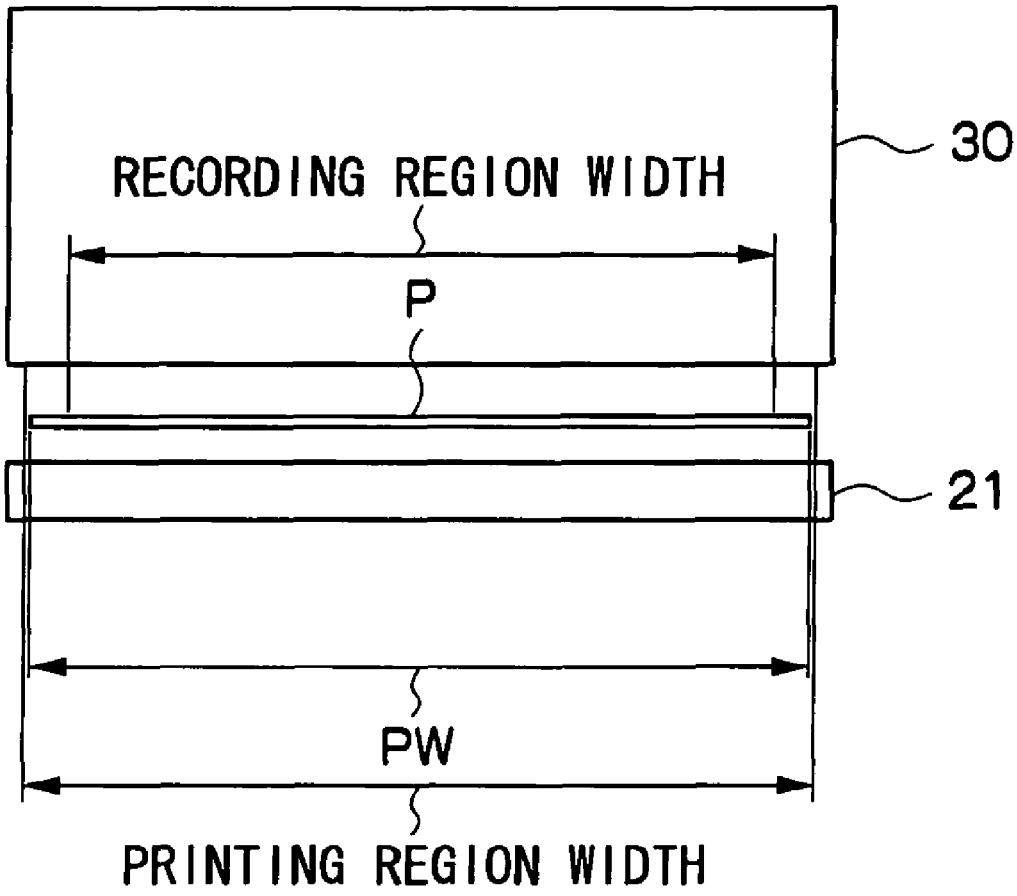
FIG. 3 is an explanatory drawing showing the relation between the width of the recording medium and the width of the printing region.

As shown in FIG. 3, the printing region width created with the nozzles 56 of each of the inkjet recording units 30 is made to be longer than the greatest paper width PW of the recording paper P onto which it is assumed that image recording with this inkjet recording device 10 will be performed. Image recording becomes possible across the entire width of the recording paper P without moving the inkjet recording unit 30 in the widthwise directions of the paper. In other words, these inkjet recording units 30 are designed with a full width array (FWA) configuration that enables single-pulse printing.

The printing region width is usually the largest portion of the recording region minus the margins at both ends in the widthwise direction of the recording paper P where printing is not performed. Generally, this is larger than the paper's largest width PW where printing is performed. This is due to the fact that there is a danger of the recording paper P inclining (i.e., becoming skewed) at a preset angle relative to the conveying direction and being conveyed skewed. Also, there is high demand for no-edge printing.

Figure 4A:
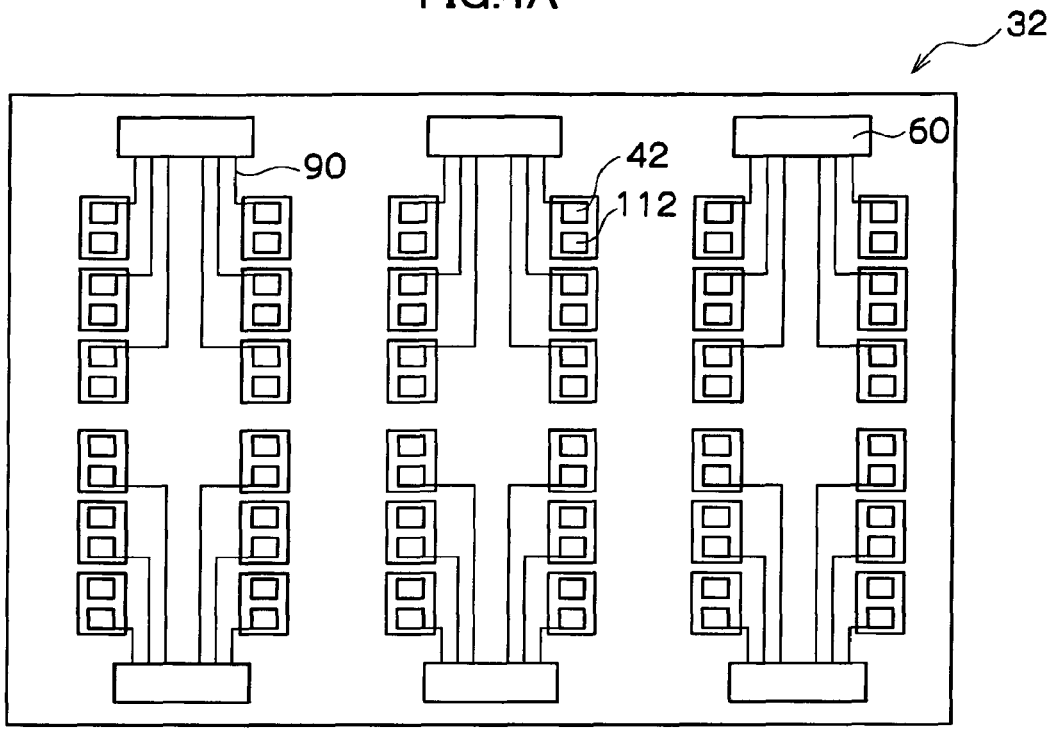
FIG. 4A is an outline planar drawing showing the overall structure of the inkjet recording head.
Figure 4B:
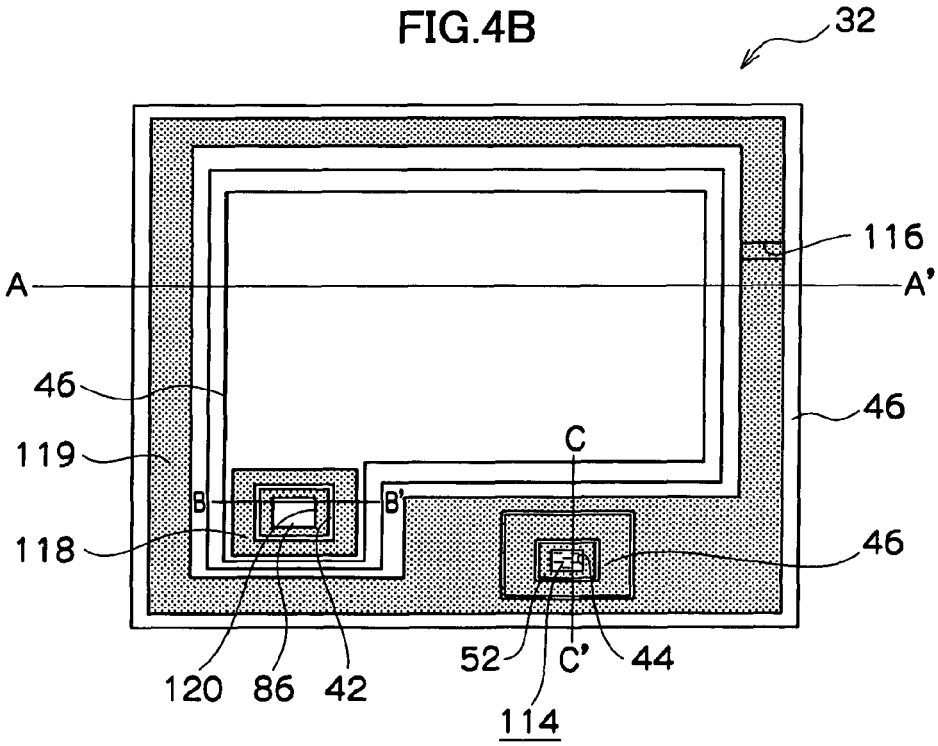
FIG. 4B is an outline planar drawing showing the structure of one element of the inkjet recording head.

Detailed explanations will be given regarding the inkjet recording head 32 in the inkjet recording device 10 configured as described above. FIGS. 4A and 4B are planar outline drawings showing the configuration of the inkjet recording head 32. FIG. 4A shows the overall configuration of the inkjet recording head 32 and FIG. 4B shows the configuration of one element.

Figure 5A:
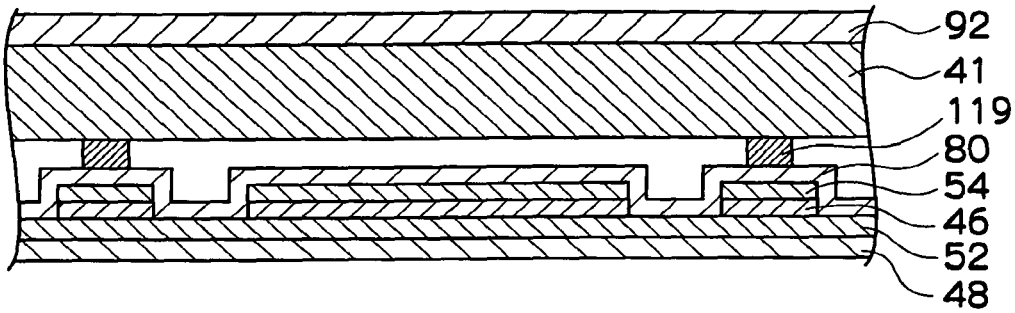
FIG. 5A is a cross-sectional drawing of the A-A' line of FIG. 4B.
Figure 5B:
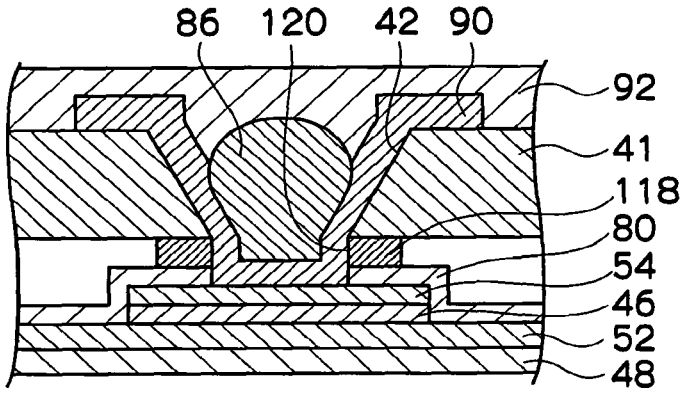
FIG. 5B is a cross-sectional drawing of the B-B' line of FIG. 4B.
Figure 5C:
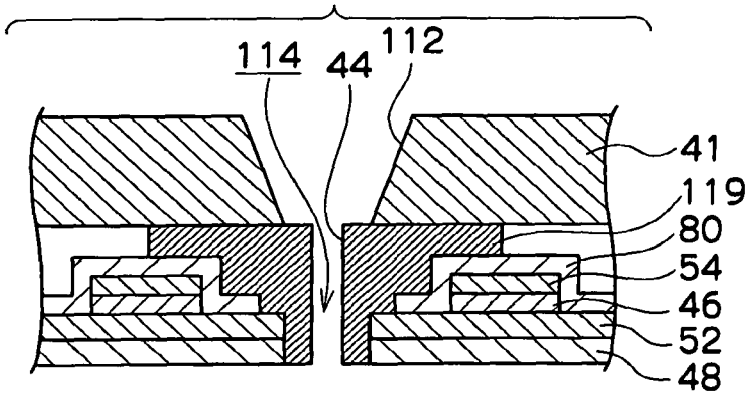
FIG. 5C is a cross-sectional drawing of the C-C' line of FIG. 4B.

Further, as shown in FIGS. 5A-5C, these show cross-sectional surfaces of each of the portions of FIG. 4B as an A-A' line, B-B' line, and C-C' line, however, a silicon substrate 72, a pool chamber component 39, and SiC film 96, which will all be described later, have been omitted from these drawings. Furthermore, FIG. 6 is an outline drawing of the vertical surface where portions of the inkjet recording head 32 have been removed in order to clearly shown the main portions thereof.

Figure 6:
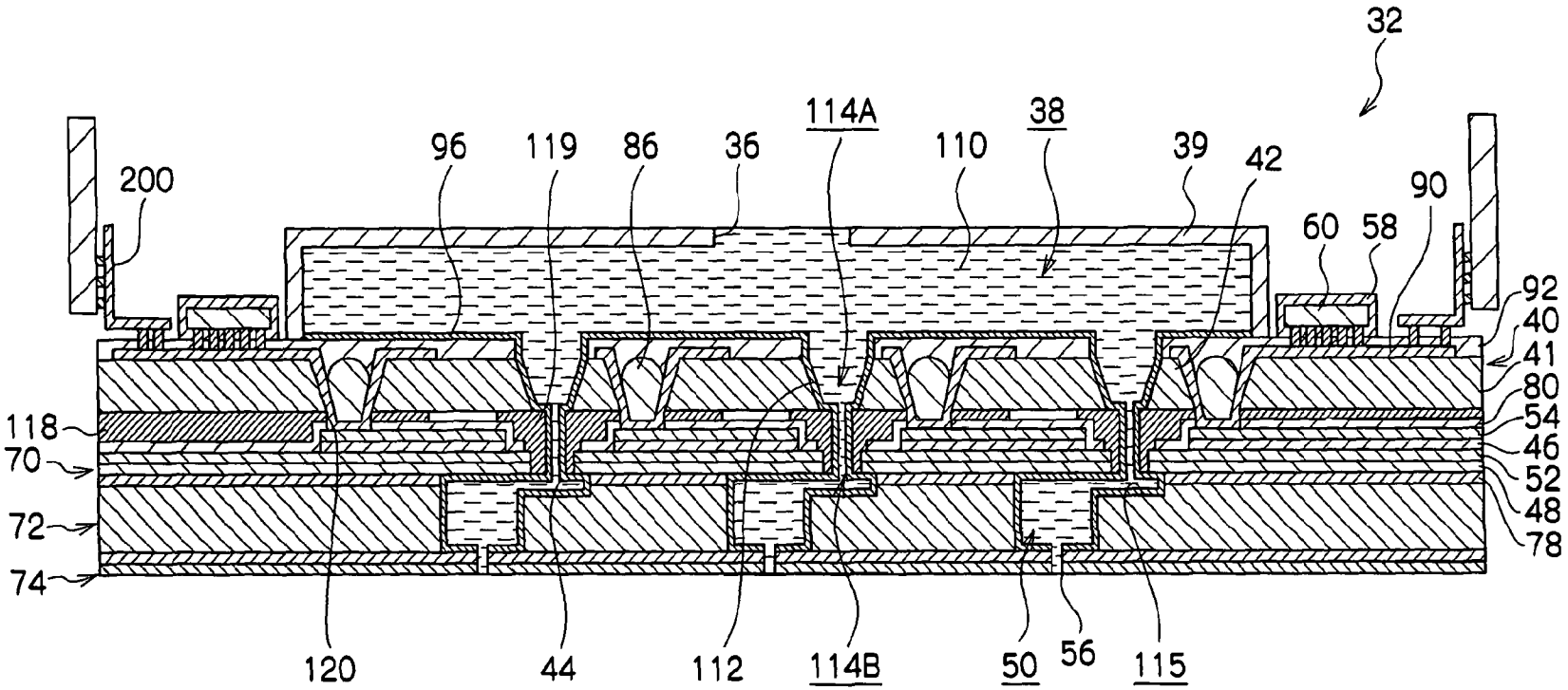
FIG. 6 is an outline cross-sectional drawing showing the composition of the inkjet recording head of the first embodiment.

As shown in FIG. 6, a top panel component 40 is arranged in this inkjet recording head 32. With the present embodiment, a top panel 41 made of glass that forms the top panel component 40 is board-shaped and has wiring, and the top panel 41 becomes the top panel for the entire inkjet recording head 32. Drive IC 60 and metal wiring 90 for distributing power to the drive IC 60 are provided at the top panel component 40. The metal wiring 90 is covered and protected by a resin protective film 92 so as to prevent corrosion by the ink 110.

Figure 7:
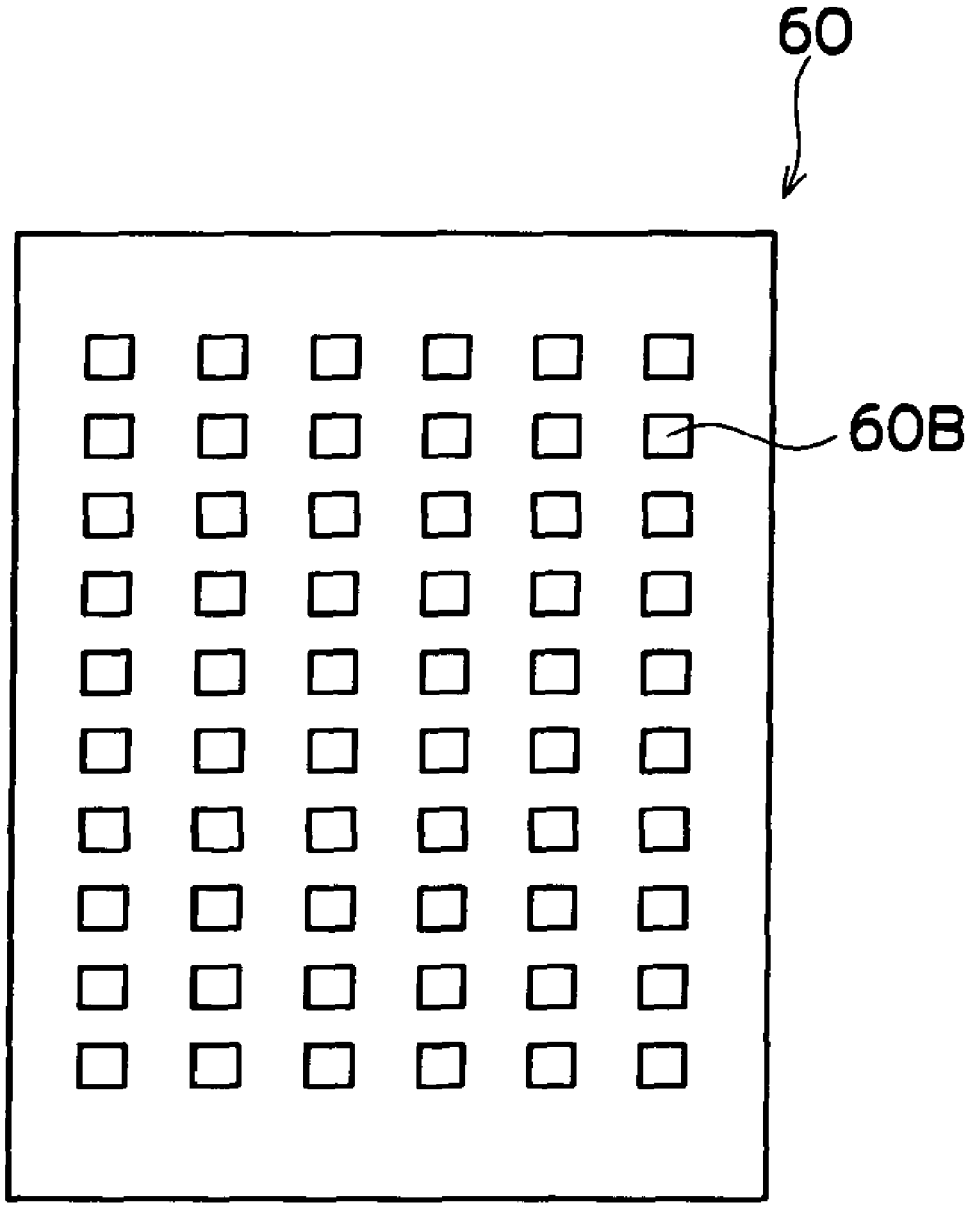
FIG. 7 is an outline planar drawing showing the bumps of the drive IC of the inkjet recording head.

As shown in FIG. 7, multiple bumps 60B are arranged on the bottom surface of the drive IC 60 in a matrix pattern so as to protrude at a preset height, and flip chips are mounted on the metal wiring 90 on the top panel 41 further to the outer side of the pool chamber component 39. Accordingly, high-density wiring and low resistance relative to a piezoelectric element 46 is easily achieved, whereby the inkjet recording head 32 can be made to be compact. It should be noted here that the periphery of the drive IC 60 is sealed with a resin material 58 as indicated in FIG. 6.

As shown in FIG. 6, the pool chamber component 39 formed from an ink-resistant material is adhered to the top panel component 40, and an ink pool chamber 38 having a preset form and volume is formed between the pool chamber component 39 and the top panel 41. An ink supply port 36 is provided in the pool chamber component 39 at a preset place so as to connect to an ink tank (not shown). The ink 110 infused from the ink supply port 36 accumulates in the ink pool chamber 38.

In the top panel 41, pressure chambers 115, which will be described later, and ink supply through-ports 112 are formed one-on-one, and the interior thereof becomes a first ink supply route 114A. Further, electric connection through-ports 42 are formed in the top panel 41 at positions corresponding to an upper electrode 54, which will be described later. The metal wiring 90 of the top panel 41 extends until the interior of the electric connection through-port 42 and covers the inner surface of the electric connection through-port 42 and further contacts the upper electrode 54.

Due to this configuration, the metal wiring 90 and the upper electrode 54 are electrically connected so individual wiring for a piezoelectric element substrate 70, which will be described later, becomes unnecessary. It should be noted that the lower portion of the electric connection through-port 42 becomes a bottom 42B (see FIG. 11B) sealed by the metal wiring 90, and the electric connection through-port 42 becomes a closed space except for the upper area only, which remains open.

The pressure chamber 115 that is filled with the ink 110 supplied from the ink pool chamber 38 is formed in the silicon substrate 72 that acts as the channel substrate, and this is made such that ink droplets discharge from the nozzle 56 that is communicated with the pressure chamber 115. The ink pool chamber 38 and the pressure chamber 115 are configured such that these do not exist on the same horizontal surface. Accordingly, it becomes possible to arrange the pressure chambers 115 in a state where they are in close proximity with each other, and the nozzles 56 can be arranged in a highly dense matrix pattern.

A nozzle plate 74 in which the nozzles 56 are formed is adhered to the undersurface of the silicon substrate 72, and the piezoelectric element substrate 70 is formed (i.e., made) on the upper surface of the silicon substrate 72. The piezoelectric element substrate 70 has a vibration plate 48. The volume of the pressure chamber 115 is made to increase and decrease with the oscillations of the vibration plate 48 and pressure waves are generated, whereby ink droplets can be discharged from the nozzles 56. Accordingly, the vibration plate 48 forms one surface of the pressure chamber 115.

The piezoelectric element 46 is adhered to the upper surfaces of the vibration plate 48 at each pressure chamber 115. The vibration plate 48 is an SiOx film formed with a chemical vapor deposition (CVD) method (i.e., a chemical vapor growth method) and has elasticity at least in the up and down directions. The piezoelectric element 46 is configured such that when current is applied thereto (i.e., when voltage is applied), the piezoelectric element 46 flex deforms (i.e., displaces) in the up and down directions. It should be noted that the vibration plate 48 can be safely made from a metal material such as Cr and the like.

Further, a lower electrode 52 having one polarity is arranged at the undersurface of the piezoelectric element 46, and the upper electrode 54 forming the other polarity is arranged on the upper surface of the piezoelectric element 46. The piezoelectric element 46 is then covered and protected by an insulating layer having low water-permeability (hereafter, simply referred to as "SiOx film 80"). The SiOx film 80 that covers and protects the piezoelectric element 46 is coated thereon with the condition that moisture permeation lowers. Accordingly, penetration of moisture into the interior of the piezoelectric element 46 and subsequent ruining of reliability can be prevented (i.e., deterioration of piezoelectric qualities occurring due to reduction of oxygen within the PZT coating that is the piezoelectric element 46).

Further, a dividing wall resin layer 119 is layered on the SiOx film 80. As shown in FIG. 6, the dividing wall resin layer 119 partitions a space between the piezoelectric element substrate 70 and the top panel component 40. Ink supply through-ports 44 that respectively connect to the ink supply through-ports 112 of the top panel 41 are formed in the dividing wall resin layer 119, and the each interior thereof becomes a second ink supply route 114B.

The each second ink supply route 114B has a cross-sectional area smaller than that of the first ink supply route 114, and the channel resistance of the entire ink supply route 114 is adjusted to become a preset value. That is, the cross-sectional area of the first ink supply route 114A is made to be sufficiently larger than the cross-sectional area of the second ink supply route 114B. Accordingly, when compared to the channel resistance of the second ink supply route 114B, the resistance is set to a degree that can actually be ignored. For this reason, the channel resistance of the ink supply route 114 from the ink pool chamber 38 to the pressure chamber 115 is regulated solely by the second ink supply route 114B.

Also, at the very least, the wall surfaces that contact the ink 110 (i.e., the inner wall surfaces of the resin protective film 92, the ink supply through-port 112, the dividing wall resin layer 119, the pressure chamber 115, and a connection route 50) have the SiC film 96 film uniformly formed (i.e., coated) thereon with a plasma CVD method. Accordingly, the ink resistance of these wall surfaces is improved.

A dividing wall resin layer 118 is also layered at positions corresponding to the electric connection through-ports 42. As shown in FIG. 6, a through-hole 120 that connects with the metal wiring 90 is formed in the dividing wall resin layer 118, and the bottom of the metal wiring 90 can thus contact the upper electrode 54. It should be noted that in FIG. 6, the dividing wall resin layer 118 and the dividing wall resin layer 119 are shown as cross sections at positions that are separated from each other, however, in actual practice, these are partially connected.

An interval is formed between the top panel component 40 and the piezoelectric element 46 (stated more accurately, between the SiOx film 80 on the piezoelectric element 46) due to the dividing wall resin layers 118, 119 and this thus becomes a layer of air. Due to this air layer, there are no adverse effects on the driving of the piezoelectric element 46 and the oscillation of the vibration plate 48. Also, an air connection hole 116 is formed in the dividing wall resin layer 119 (see FIG. 4B) so pressure changes in the air space in the top panel 41 and the piezoelectric element substrate 70 are reduced when the inkjet recording head 32 is being manufactured or during image recording.

Also, as is shown in FIG. 6, solder 86 is filled into the interior of the electric connection through-port 42 so as to come into contact with the metal wiring 90. Due to this, the metal wiring 90 is substantially reinforced and the state of contact with the upper electrode 54 (i.e., the state of electrical contact) is improved. Accordingly, even if the state of contact deteriorates due to, for example, heat stress or mechanical stress, the state of contact is maintained well due to the solder 86.

Accordingly, signals from the drive IC 60 are conducted to the metal wiring 90 of the top panel component 40 and also conducted from the metal wiring 90 to the upper electrode 54. Voltage is then applied to the piezoelectric element 46 at preset timing and the vibration plate 48 flex deforms in the up and down directions, whereby the ink 110 filled in the pressure chamber 115 is pressurized and ink droplets are discharged from the nozzle 56.

The upper surfaces of the dividing wall resin layer 119 and the dividing wall resin layer 118 are at a constant height, that is, these are made to be one surface. Accordingly, the heights (i.e., distances) of the surfaces of the dividing wall resin layer 119 and the dividing wall resin layer 118 that face each other, as measured from the top panel 41, are also the same. Due to this, the degree of contact with the top panel 41 upon contact increases and the sealing quality also increases. A flexible print circuit 200 (FPC) is also connected to the metal wiring 90.

Figure 8:
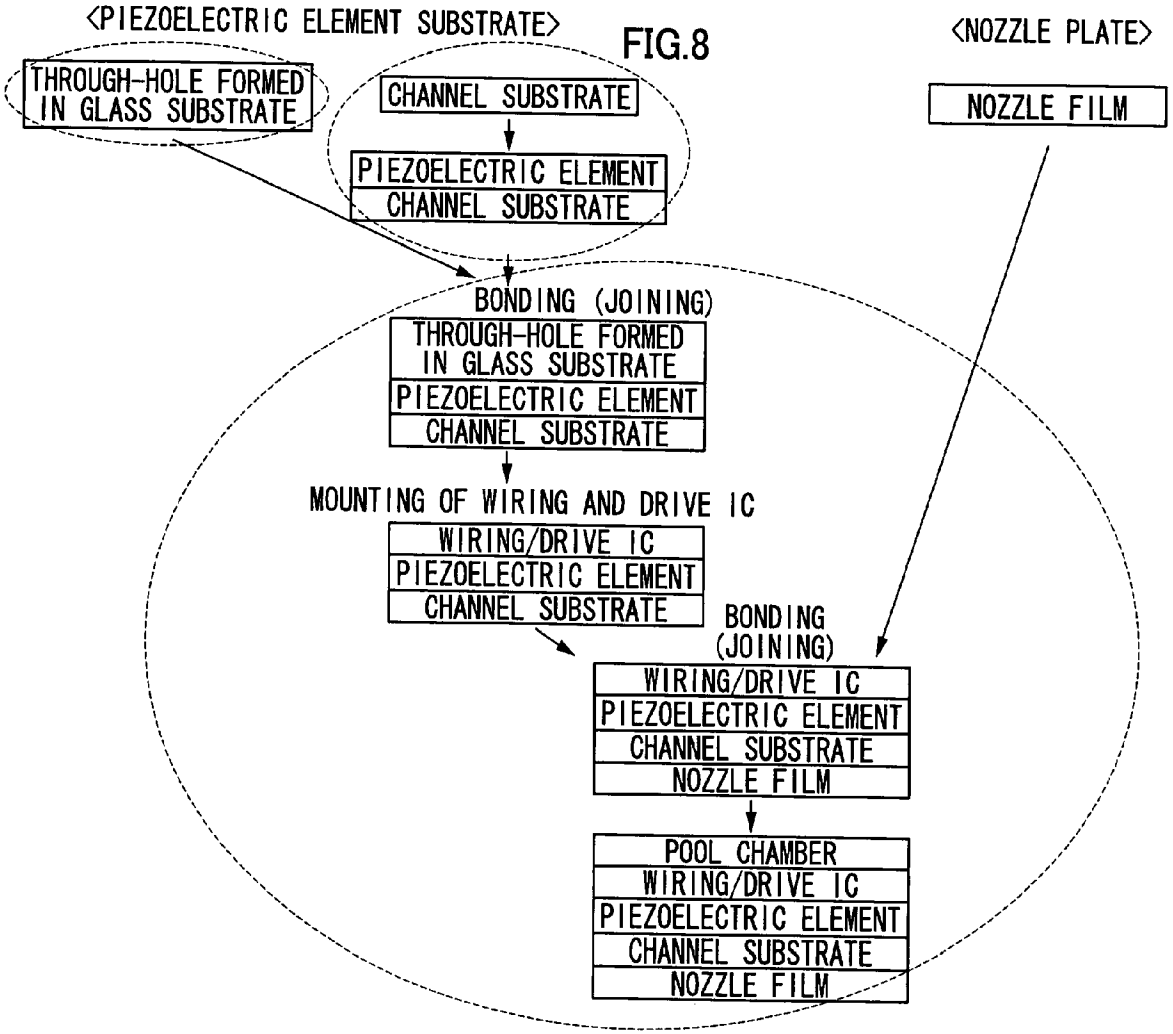
FIG. 8 is an explanatory drawing of the entire process for manufacturing the inkjet recording head of the first embodiment.

The manufacturing process of the inkjet recording head 32 configured as described above will be explained in detail based on the drawings in FIGS. 8-12F. As shown in FIG. 8, the inkjet recording head 32 is manufactured by making the piezoelectric element substrate 70 on the upper surface of the silicon substrate 72 as a channel substrate, after which the nozzle plate 74 (i.e., a nozzle film 68) is joined (i.e., adhered) to the undersurface of the silicon substrate 72.

Figures 9A, 9B, 9C, 9D:
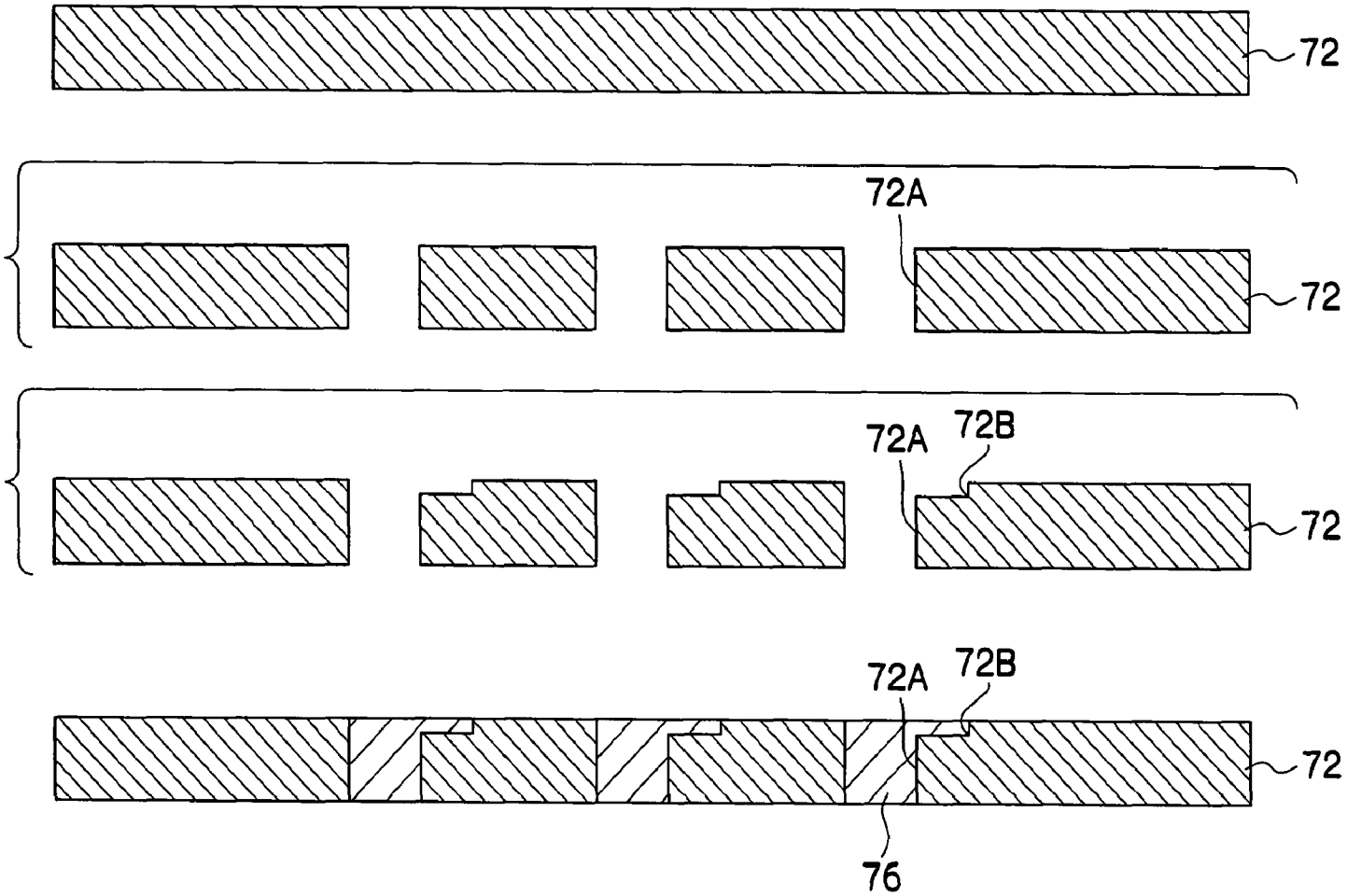
FIGS. 9A-9D are explanatory drawings showing a process for manufacturing the piezoelectric element substrate of the first embodiment.

As shown in FIG. 9A, first, the silicon substrate 72 is prepared. Then, as shown in FIG. 9B, an opening 72A is formed with a reactive ion etching (RIE) method in the region that will become the connection route 50 of this silicon substrate 72. Specifically, resist formation is performed with a photolithographic method, patterning is done, etching is performed with a RIE method, and resist peeling is performed with oxygen plasma.

As shown in FIG. 9C, a groove 72B is formed in the region that will become the pressure chamber 115 of this silicon substrate 72. Specifically, as described above, resist formation is performed with a photolithographic method, patterning is done, etching is performed with a RIE method, and resist peeling is performed with oxygen plasma. With this, a multi-step configuration for the portion that will become the pressure chamber 115 and the connection route 50 are formed.

Figures 13A, 13B:
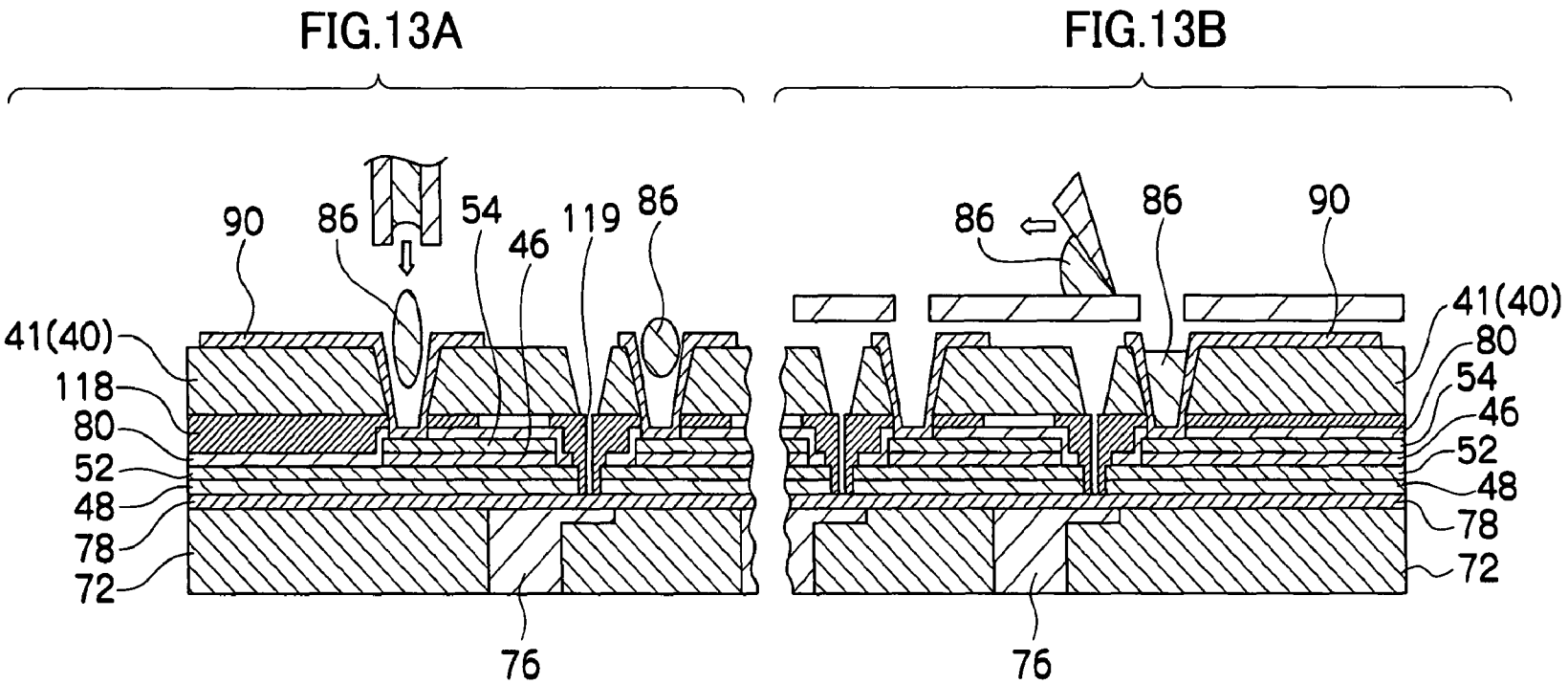
FIG. 13A is an explanatory drawing showing another method of mounting solder.
FIG. 13B is an explanatory drawing showing yet another method of mounting solder.

After that, as shown in FIG. 9D, glass paste 76 is filled (i.e., embedded) into the opening 72A that forms the connection route 50 and the groove 72B that forms the pressure chamber 115 with a screen printing method (see FIG. 13B). The thermal expansion coefficient of this glass paste 76 is between $1\times10^{-6}/°$ C. and $6\times10^{-6}/°$ C., and the softening point is reached at between 550° C. and 900° C. By using the glass paste 76 having these ranges, the occurrence of cracks and peeling in the glass paste 76 can be prevented and furthermore, in subsequent processes, deformations in thin layers that become components such as the piezoelectric element 46 and the vibration plate 48 can also be prevented.

Then after the glass paste 76 is filled therein, heat processing is performed on the silicon substrate 72, for example, at 800° C. for 10 minutes. The temperature used in the hardening heat processing of this glass paste 76 is higher than the temperature used in the film formation (e.g., 350° C.) of the piezoelectric element 46 and the vibration plate 48, which will be described later. Due to this, the glass paste 76 can be endowed with resistance to the high temperatures that are exhibited in the film-formation processes of the vibration plate 48 and the piezoelectric element 46. That is, at subsequent steps, the temperature can be set to up to at least the temperature at which hardening heat processing was performed on the glass paste 76. For this reason, the range of allowable temperatures that can be used in subsequent steps is increased.

After that, the upper face (i.e., surface) of the silicon substrate 72 is polished and excess glass paste 76 is removed, and the upper face (i.e., surface) is flattened. Due to this, formation of thin layers on the regions that will become the pressure chamber 115 and the connection route 50 can be performed with high accuracy.

Figure 9E:
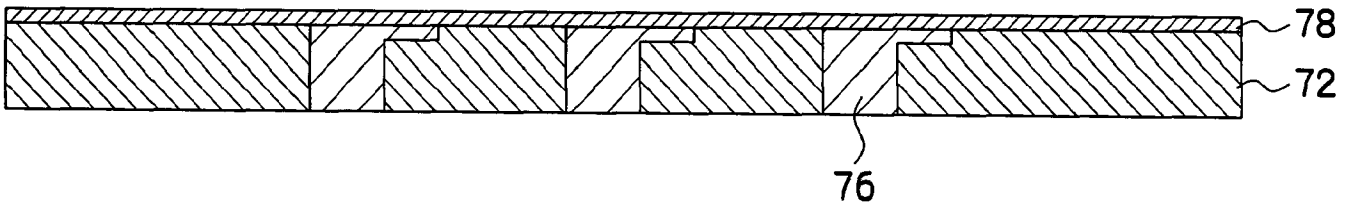
FIGS. 9E-9G are explanatory drawings showing a process for manufacturing the piezoelectric element substrate of the first embodiment.

As shown in FIG. 9E, a germanium (Ge) film 78 (film thickness: 1 μm) is coated onto the upper face (i.e., surface) of the silicon substrate 72 with a sputter method. This Ge film 78 functions as an etching stopper layer that protects a SiOx film 82 (i.e., the vibration plate 48) that will be described later, so that at later steps, the SiOx film 82 is not etched with the glass paste 76 when the paste is removed by etching with a hydrogen fluoride (HF) fluid. Incidentally, this Ge film 78 can be formed with a vapor deposition method or a CVD method. Further, a silicon (Si) film can also be used for the etching preventing layer.

Figure 9F:
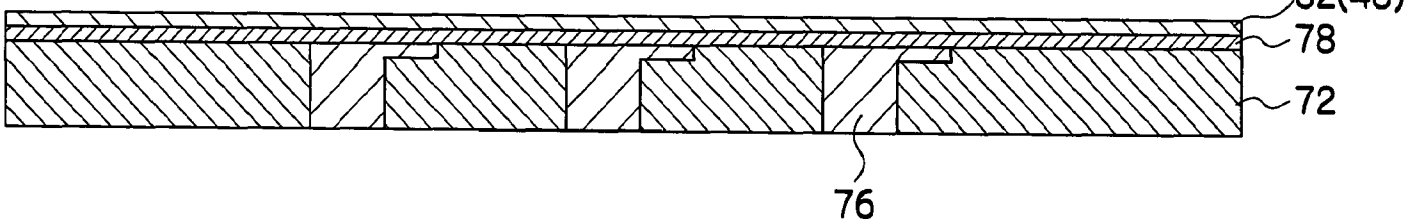

Then, as shown in FIG. 9F, a thin layer (the SiOx film 82) that will become the vibration plate 48 is formed on the upper surface of the Ge film 78 using, for example, a plasma CVD method with a temperature of 350° C., an RF power of 300 W, a frequency of 450 KHz, a pressure of 1.5 torr, and with a gas of $SiH_4/N_2O$=150/4000 sccm. The material for the vibration plate 48 in this case can be a SiNx film, SiC film, or a metal film (e.g., Cr) and the like.

Figure 9G:
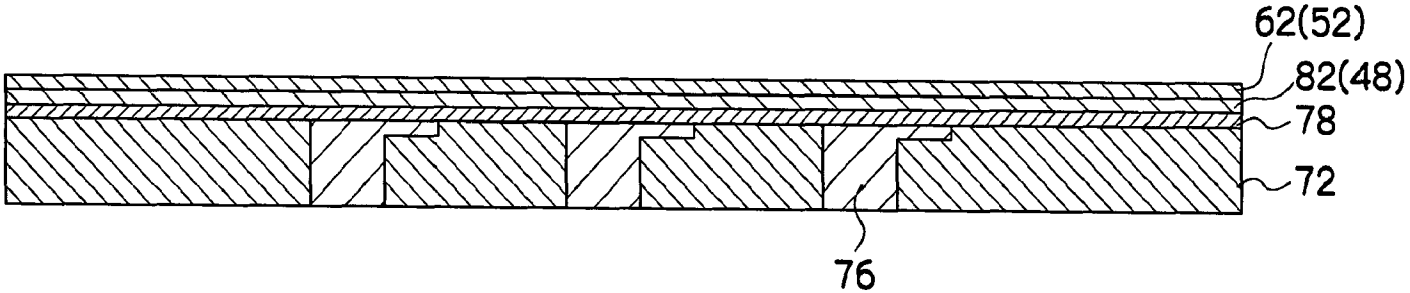
Figure 9H:
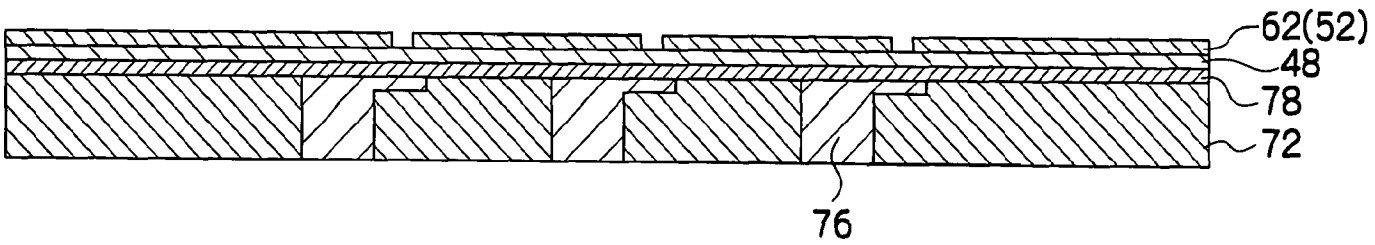
FIGS. 9H-9J are explanatory drawings showing a process for manufacturing the piezoelectric element substrate of the first embodiment.

After that, as shown in FIG. 9G, a Au film 62, that is, the lower electrode 52, is formed with a thickness in the range of, e.g., 0.5 μm. Then, as shown in FIG. 9H, the lower electrode 52 layered on the upper surface of the vibration plate 48 is patterned. Specifically, resist formation is performed with a photolithographic method, patterning is done, etching is performed with a RIE method, and resist peeling is performed with oxygen plasma. This lower electrode 52 becomes the ground potential.

Figure 9I:
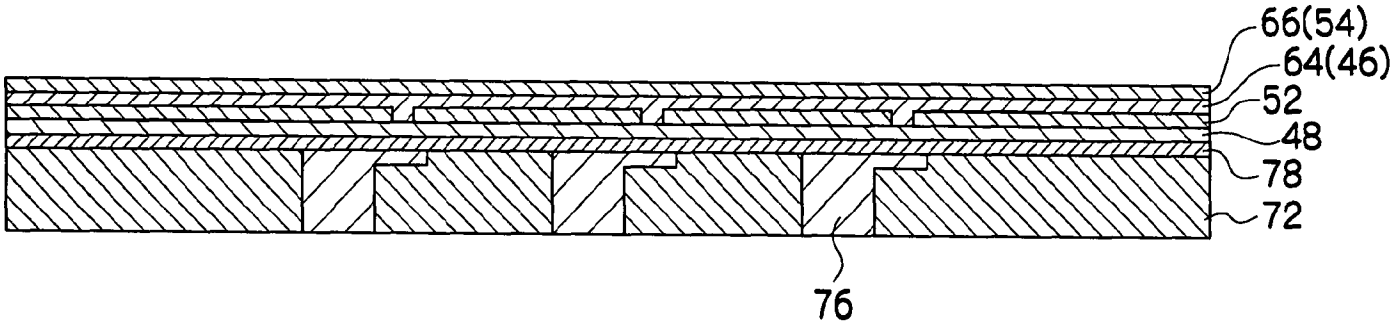
Figure 9J:
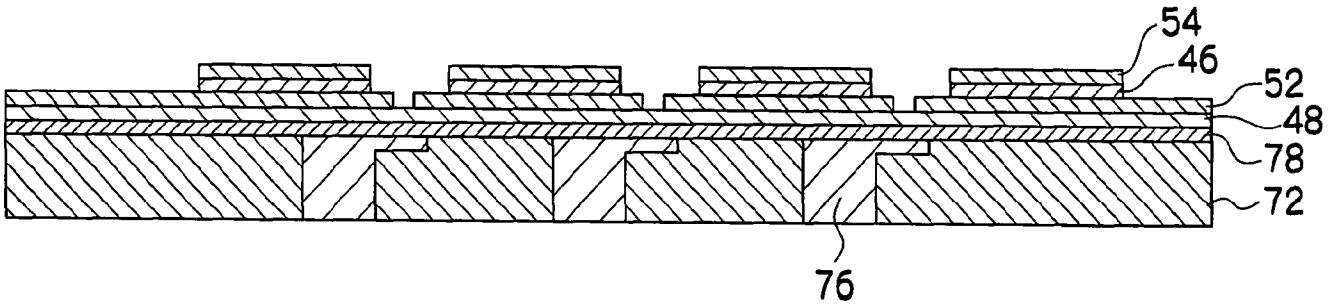

Next, as shown in FIG. 9I, a PZT film 64, which is the material for the piezoelectric element 46, and the Au film 66, which becomes the upper electrode 54, are layered in this order on the upper surface of the lower electrode 52 with a sputter method. As shown in FIG. 9J, the piezoelectric element 46 (i.e., the PZT film 64) and the upper electrode 54 (i.e., the Au film 66) are patterned.

Specifically, resist formation is performed with a photolithographic method, PZT film sputtering (film thickness: 5 μm), and Au film sputtering (film thickness: 0.5 μm); patterning (etching) is done; and resist peeling is performed with oxygen plasma. Examples of materials that can be used for the upper and lower electrodes include Au, Ir, Ru, and Pt, which are heat-resistant and have high affinities with the PZT material that is the piezoelectric element 46.

Figure 9K:
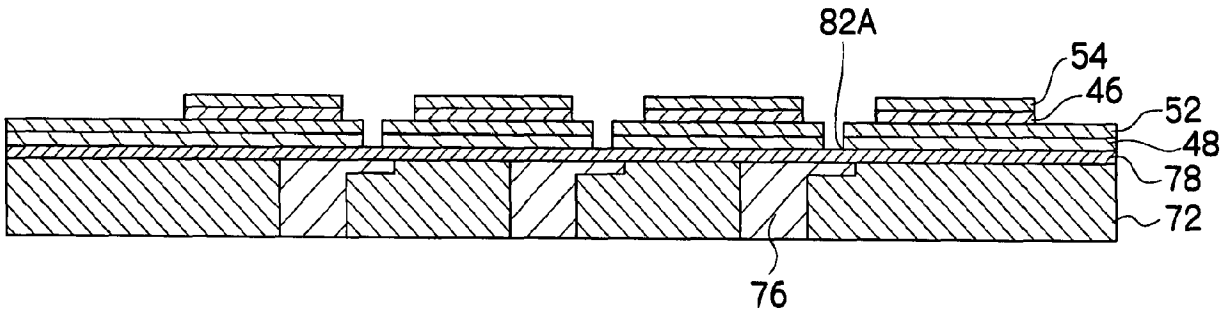
FIGS. 9K-9M are explanatory drawings showing a process for manufacturing the piezoelectric element substrate of the first embodiment.

After that, as shown in FIG. 9K, a hole 82A for the formation of the ink supply route 114 is patterned in the vibration plate 48 (i.e., the SiOx film 82). Specifically, resist formation is performed with a photolithographic method, patterning (i.e., HF etching) is done, and resist peeling is performed with oxygen plasma.

Figure 9L:
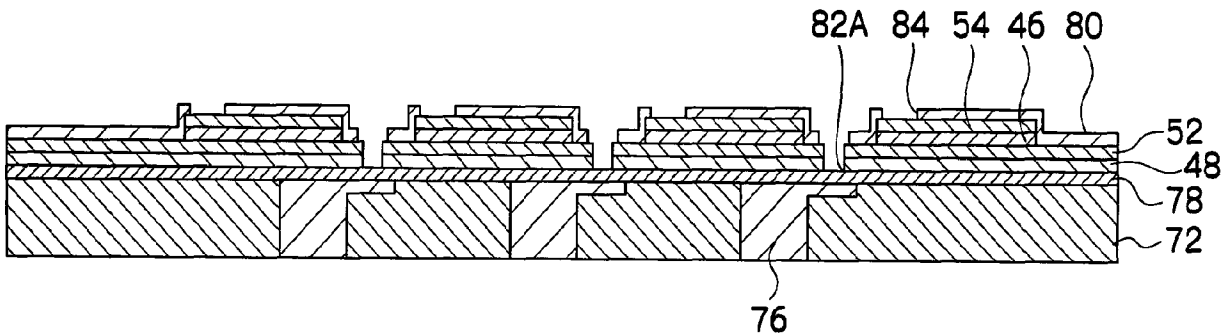

Next, as shown in FIG. 9L, the SiOx film 80 is layered on the upper surfaces of the lower electrode 52 and upper electrode 54 that are exposed at the upper surface. An opening 84 (contact hole) for connecting the upper electrode 54 and the metal wiring 90 is then formed with patterning. Specifically, the SiOx film 80, which has a high dangling-bond density, is coated with a CVD method, resist formation is performed with a photolithographic method, patterning (i.e., HF etching) is done, and resist peeling is performed with oxygen plasma. It should be noted that although a SiOx film was used here as the insulating film having low water-permeability, this can be a film such as a SiNx film or SiOxNy film.

Figure 9M:
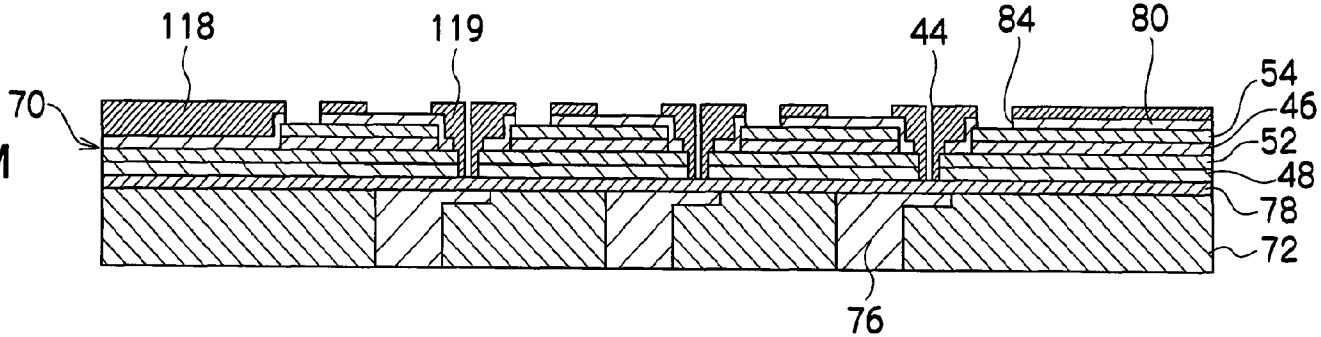

Next, as shown in FIG. 9M, the dividing wall resin layer 119 and the dividing wall resin layer 118 are patterned. Specifically, a photosensitive resin comprising the dividing wall resin layer 119 and dividing wall resin layer 118 is coated thereon, a pattern is formed by exposure/development, and finally, the structure is cured. The ink supply through-port 44 is formed at this time in the dividing wall resin layer 119.

Note that the dividing wall resin layer 119 and the dividing wall resin layer 118 are the same film, however, their respective design patterns differ. Further, the photosensitive resin forming the dividing wall resin layer 119 and dividing wall resin layer 118 can be any type of material such as a polyimide, polyamide, epoxy, polyurethane, or silicon, as long as it is resistant to ink.

Figure 10A:
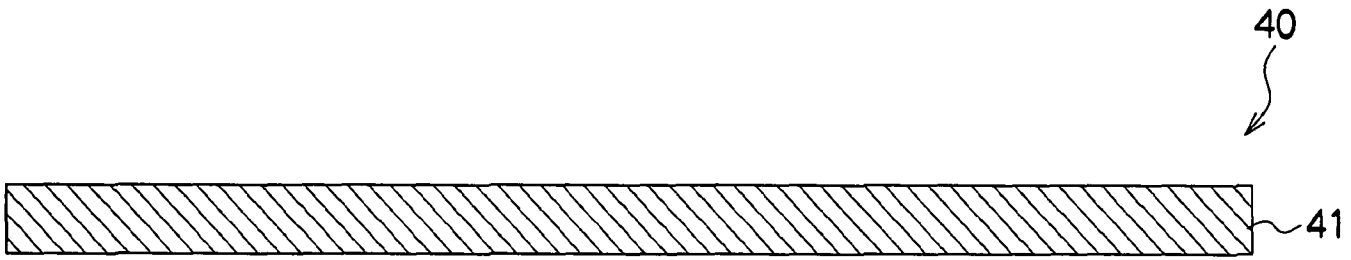
FIGS. 10A-10B are explanatory drawings showing the process of manufacturing a top panel component of the first embodiment.
Figure 10B:
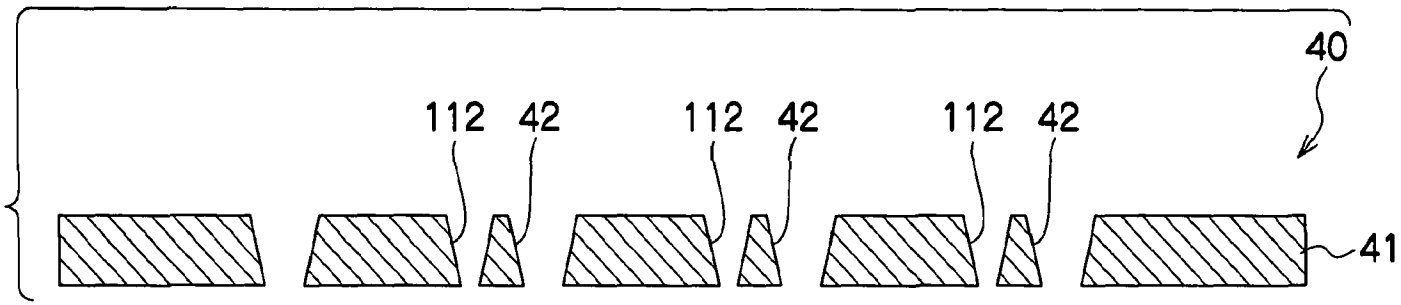

In this manner, the piezoelectric element substrate 70 is made on the upper surface of the silicon substrate 72 (i.e., the channel substrate). The top panel component 40 that is, for example, a glass board acting as a substrate, is attached (i.e., joined) to the upper surface of this piezoelectric element substrate 70. In the manufacturing of the top panel component 40, as shown in FIG. 10A, the top panel component 40 itself includes the top panel 41 that is thick enough to ensure the degree of strength to serve as a support (0.3-1.5 mm), so it is not necessary to provide a separate support. As shown in FIG. 10B, the ink supply through-port 112 and electric connection through-port 42 are formed in this top panel 41.

Specifically, a resist of photosensitive dry film is patterned with a photolithographic method, and this resist is used as a mask when sand blasting is performed to form openings, after which the resist is peeled with oxygen plasma. The inner surfaces of the ink supply through-port 112 and the electric connection through-port 42, when viewed as cross sections, are formed so as to taper downwards (i.e., in a funnel shape) so their respective inner surfaces gradually approach each other.

Figure 11A:
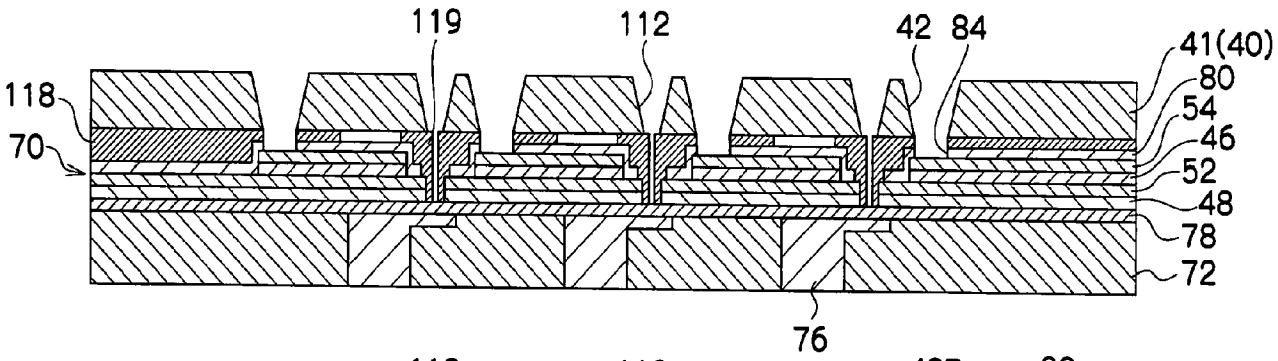
FIGS. 11A-11C are explanatory drawings showing the process after joining the piezoelectric element substrate to the top panel component of the first embodiment.

As shown in FIG. 11A, the top panel 41 (top panel component 40) in which the ink supply through-port 112 and electric connection through-port 42 were formed is overlayed with the piezoelectric element substrate 70 and both are joined (i.e., adhered) with heat pressing (e.g., at 350° C. at 2 $kg/cm^2$ for 20 min.). Since the dividing wall resin layer 119 and the dividing wall resin layer 118 are configured to be one surface (i.e., with the same heights) so their contact with the top panel 41 is enhanced and these can be joined so as to have a good seal.

Figure 11B:
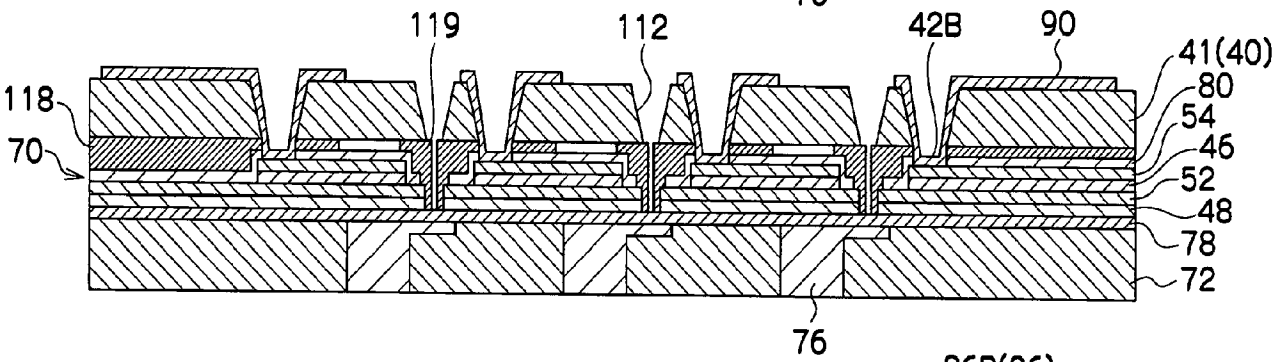

Then, as shown in FIG. 11B, the metal wiring 90 is formed on the upper surface of the top panel 41 and then patterned. Specifically, an A1 film (film thickness: 1 μm) is adhered with a sputter method, a resist is formed with a photolithographic method. The A1 film is wet-etched by using an $H_3PO_4$ chemical solution, and the resist is peeled with oxygen plasma.

It should be noted that since the step or bump of the electric connection through-port 42 is extremely large, a spray-coating method for the resist and a long-focus depth exposure method are used during the photolithography process. At this time, a portion of the metal wiring 90 is patterned so as to reach from the inner surface of the electric connection through-port 42 to the upper electrode 54.

Due to this, the bottom 42B of the electric connection through-port 42 is closed off with the metal wiring 90, so the electric connection through-port 42 becomes a closed space except for the upper portion, which is open. It should be noted that when it is desirous to form the metal wiring 90 thickly up to the deep portion of the electric connection through-port 42, it is best to employ the right CVD method that exhibits good step-coating qualities as opposed to using a sputter method.

Figure 11C:
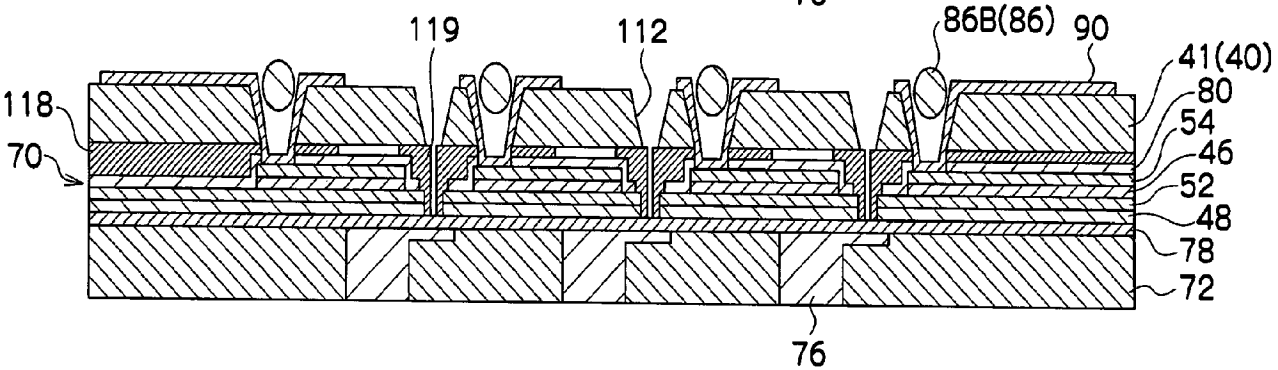

Next, the solder 86 is loaded inside of the electric connection through-port 42 where the metal wiring 90 was patterned in this manner (i.e., inside the above-described space), as shown in FIG. 11C. A solder ball method that directly loads a solder ball 86B inside the electric connection through-port 42 can be used for this method.

Besides a solder ball method, a thermally melted solder discharge supply method applying the principles of inkjet can also be used, as shown in FIG. 13. With this method, the solder 86 can be supplied to preset positions in a state of no-contact with the top panel 41 and without using a mask. Further, as shown in FIG. 13B, the solder 86 can also be supplied using a screen printing method. Regardless of the supplying method used, when viewed as a cross-section, the electric connection through-port 42 is formed so that the inner surfaces taper downwards (i.e., in a funnel shape) and gradually approach each other so it is easy for the solder 86 to adhere to the inner surfaces of the electric connection through-port 42.

Figure 11D:
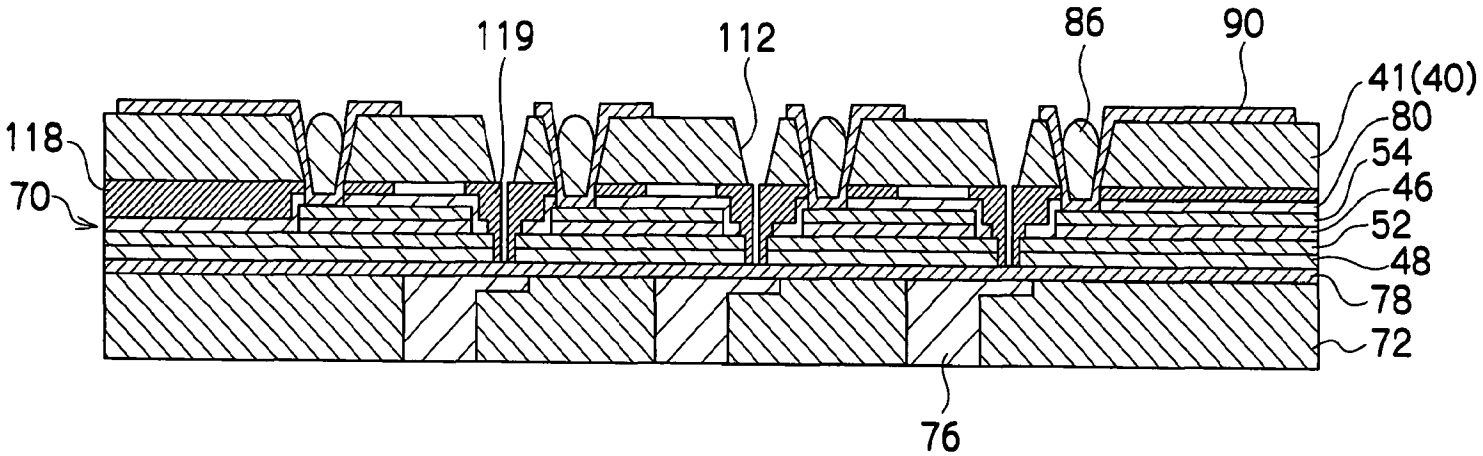
FIGS. 11D-11E are explanatory drawings showing the process after joining the piezoelectric element substrate to the top panel component of the first embodiment.

Next, as shown in FIG. 11D, the solder 86 is re-flowed (e.g., at 280° C. for 10 min.) and made to spread to the bottom 42B of the electric connection through-port 42. At this time, there is no route for the melted solder 86 to flow out at the bottom 42B of the electric connection through-port 42, so the solder 86 can be sufficiently melted in a high-temperature environment and filled up to the bottom 42B of the electric connection through-port 42 with certainty.

In other words, at this stage, the lowermost portion of the solder 86 is at a position in the electric connection through-port 42 at the side lower than the lower surface of the top panel 41 (i.e., the surface at which the metal wiring 90 is not formed) so it is certain that the solder 86 will come into contact with the metal wiring 90 inside the electric connection through-port 42. Further, the amount of solder 86 filled therein is set in advance so that melted solder 86 does not get positioned higher than the upper surface of the top panel 41 (more accurately, not higher than the upper surface of the metal wiring 90).

Here, the A1 film comprising the bottom portion of the metal wiring 90, that is, the area contacting the upper electrode 54 becomes thin, so there is a danger of the metal wiring 90 receiving mechanical stress and breaking due to thermal expansion of the dividing wall resin layer 119 and the like. Nonetheless, even in such cases, the solder 86 filled in the bottom 42B contacts the metal wiring 90 inside the electric connection through-port 42 so conduction with the solder 86 can be ensured.

Also, the amount of solder 86 filled is set in advance so as to not fill to a position higher than the upper surface of the top panel 41 (more accurately, the upper surface of the metal wiring 90). Since the melted solder 86 does not flow out, there is no danger of the solder 86 inadvertently short-circuiting the portions in proximity with the electric connection through-port 42. Furthermore, the material to be filled in the electric connection through-port 42 is not limited to the solder 86. A material such as molten metal, metal paste, and conductive adhesive can also be used. Since the rate of resistance required of these materials changes in accordance with properties of the elements, these can be appropriately selected upon consideration of the processes and matching qualities in accordance with factors such as cost and temperature of heat-resistance.

Figure 11E:
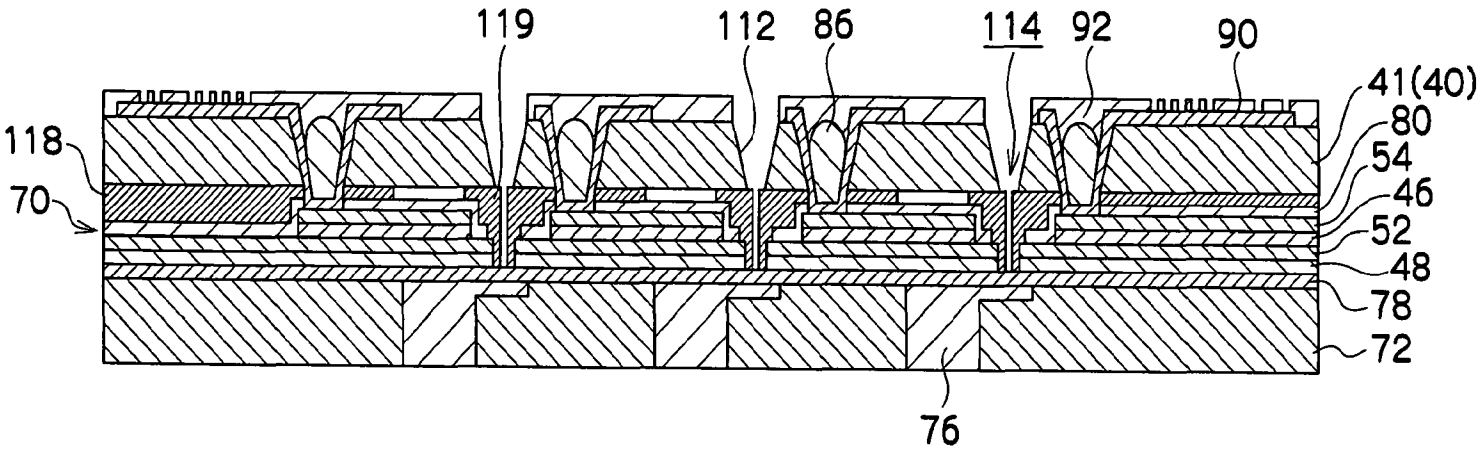

Next, as shown in FIG. 11E, the resin protective film 92 is layered on the surface where the metal wiring 90 is formed and patterned (e.g., the photosensitive polyimide Durimide 7320 made by FUJI FILM Arch Co., Ltd.). It is important to note that at this time, the first ink supply route 114 is not covered with the resin protective film 92. Also, materials such as polyimide, polyamide, epoxy, polyurethane, and silicon and the like can be used for the resin protective film 92, as long as it is resistant to ink.

Figure 11F:
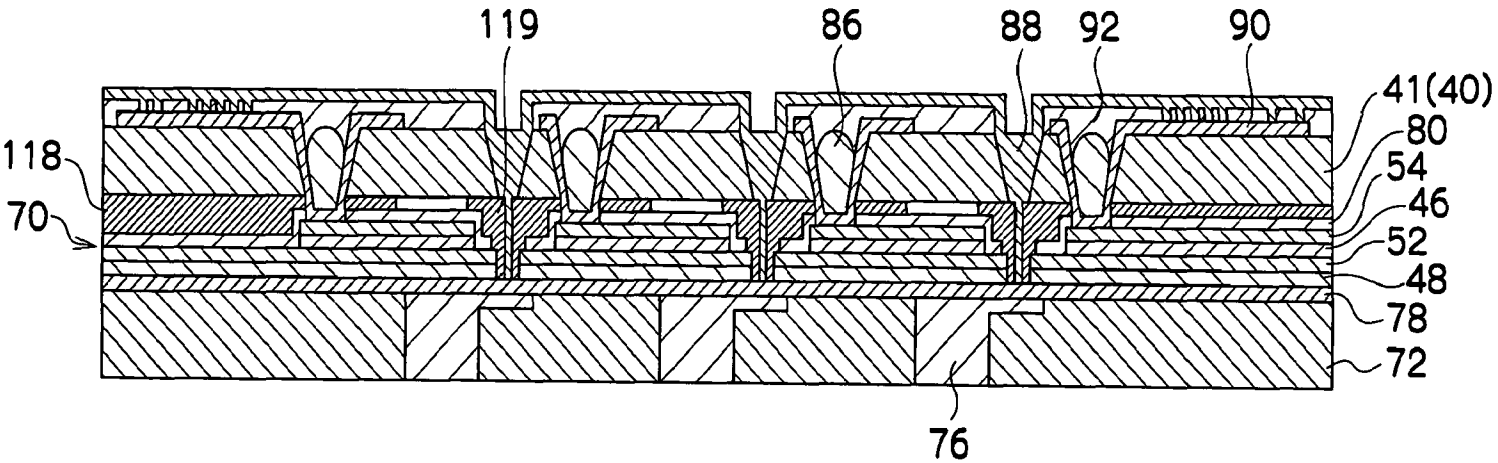
FIGS. 11F-11G are explanatory drawings showing the process after joining the piezoelectric element substrate to the top panel component of the first embodiment.
Figure 11G:
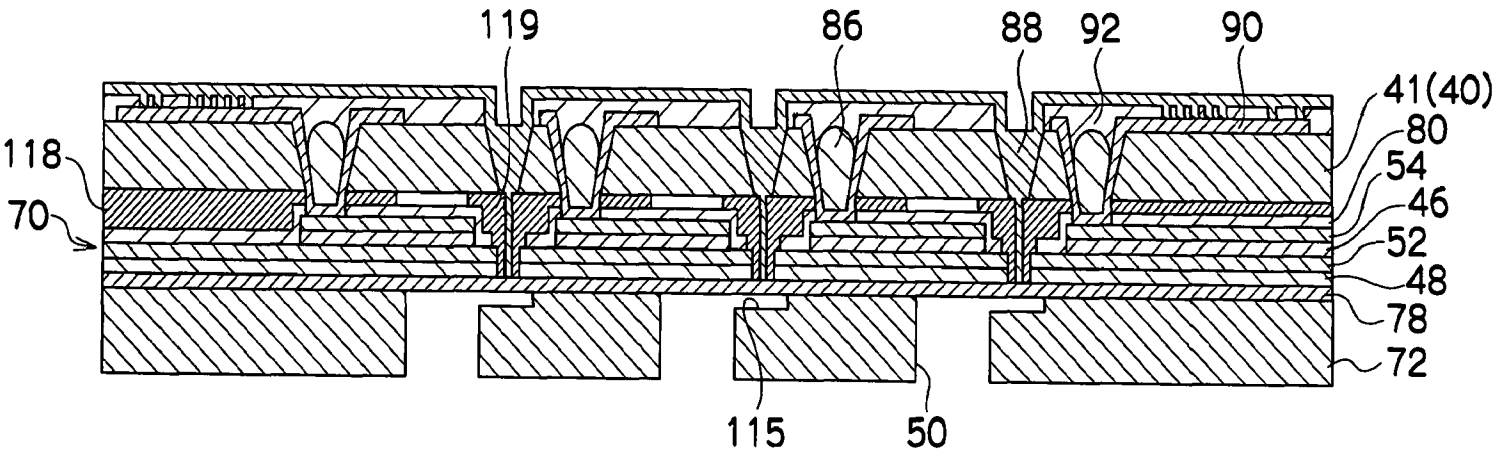

Next, as shown in FIG. 11F, an HF-resistant protective resist 88 is coated on the upper surface of the resin protective film 92 and inside the ink supply route 114. Then, as shown in FIG. 11G, the glass paste 76 filled (i.e., embedded) into the silicon substrate 72 is selectively etched and removed with a soluble fluid containing HF. At this time, the vibration plate 48 made from the SiOx film 82 is protected from the HF solution by the Ge film 78 so it is not etched.

Figure 11H:
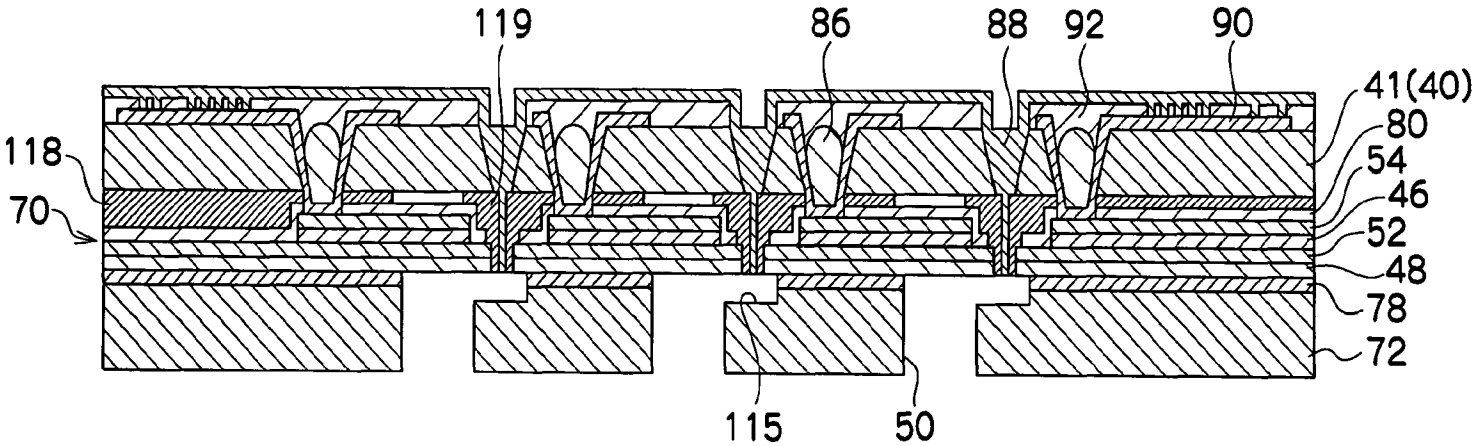
FIGS. 11H-11I are explanatory drawings showing the process after joining the piezoelectric element substrate to the top panel component of the first embodiment.
Figure 11I:
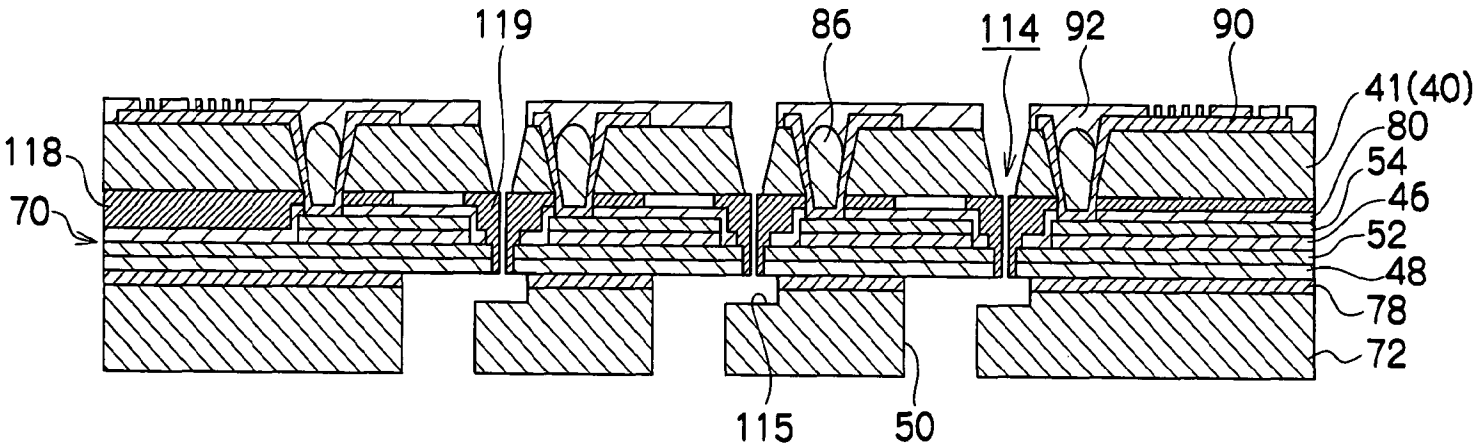

In other words, this Ge film 78 functions as an etching stopper layer that prevents the vibration plate 48 made from the SiOx film 82 from being etched and removed with the glass paste 76 when it is etched and removed with the HF solution. After that, as shown in FIG. 11H, the dissolving fluid of the Ge film 78 (e.g., hydrogen peroxide ($H_2O_2$) heated to 60° C.) is supplied from the pressure chamber 115 and this etches and removes a portion of the Ge film 78. At this stage, the pressure chamber 115 and the connection route 50 are completed. In this manner, once the Ge film 78 is etched and removed, the HF-resistant protective resist 88 is removed with acetone, as shown in FIG. 11I. With the exception of the areas where the pressure chamber 115 and the connection route 50 were formed, the Ge film 78 remains as is, however, this poses no problems.

Figure 12A:
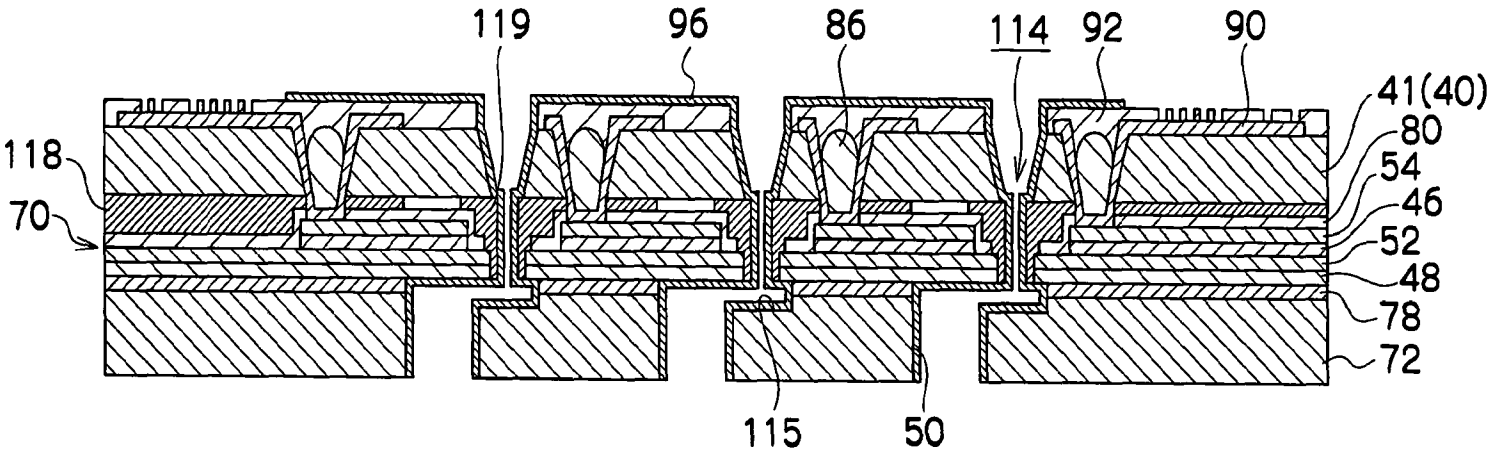
FIGS. 12A-12B are explanatory drawings showing the process after joining the nozzle plate to the piezoelectric element substrate of the first embodiment.

Then, as shown in FIG. 12A, at least the inner wall surfaces that contact the ink 110, that is, the inner wall surfaces of the resin protective film 92, ink supply through-port 112, dividing wall resin layer 119, pressure chamber 115, and connection route 50 have the SiC film 96 (film thickness: 1 μm) uniformly formed thereon with a plasma CVD method including their adjoining portions (i.e., boundary portions). Due to this, resistance to ink of the inner wall surfaces that contact the ink 110 is improved. It should be noted that on the upper surface of the resin protective film 92, it is not necessary to form the SiC film 96 in the area further to the outer side where the pool chamber component 39 is attached. Further, when the raw material gas used at the time of production includes nitrogen ($N_2$), there are cases where 0-30% of $N_2$ is included in the SiC film 96. It is preferable that the amount of $N_2$ contained in the SiC film 96 as the ink-resistant film be 10% or less.

Figure 12B:
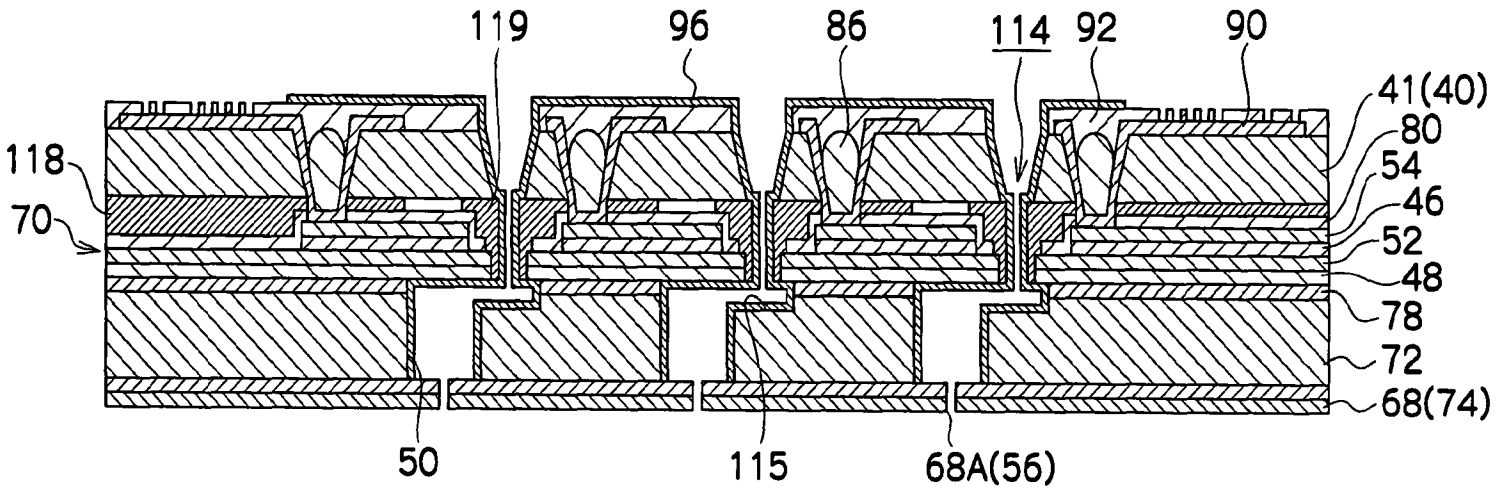
Figure 12C:
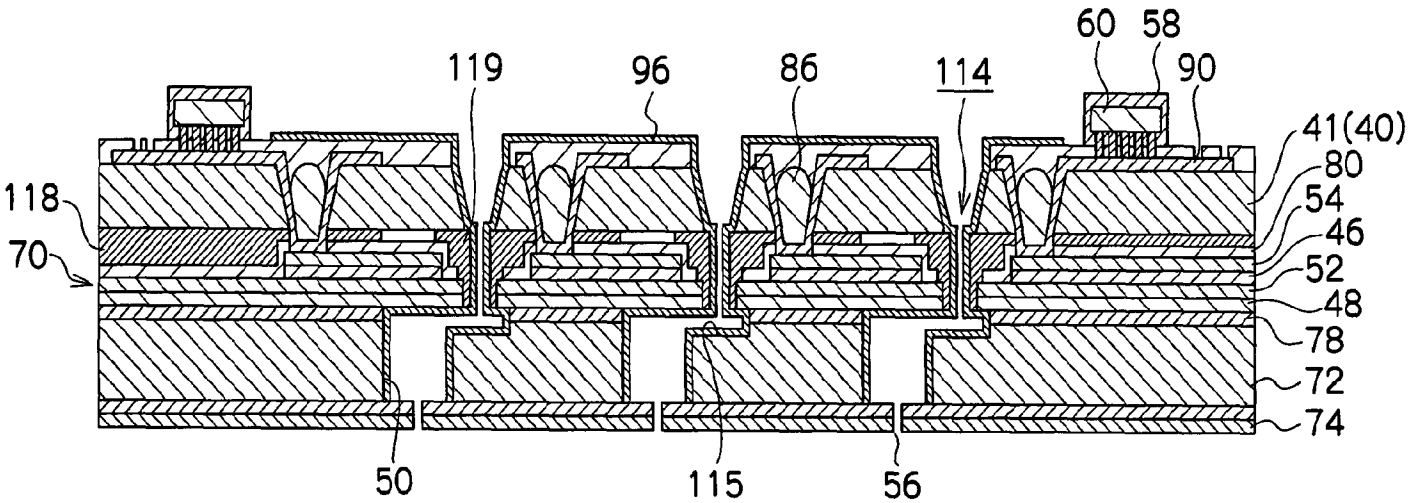
FIGS. 12C-12D are explanatory drawings showing the process after joining the nozzle plate to the piezoelectric element substrate of the first embodiment.

Next, the nozzle plate 74 is adhered to the undersurface of the silicon substrate 72. That is, as shown in FIG. 12B, the nozzle film 68 that has the openings 68A that will become the nozzles 56 formed therein is stuck to the undersurface of the silicon substrate 72. After that, as shown in FIG. 12C, the drive IC 60 is flip chip attached to the metal wiring 90. At this time, the drive IC 60 is processed to a preset thickness (70-300 μm) with grind processing at the end of semiconductor wear processing, which is performed in advance. Then the periphery of the drive IC 60 is sealed with the resin material 58 so that the drive IC 60 can be protected from moisture and the like from the external environment.

Figure 12D:
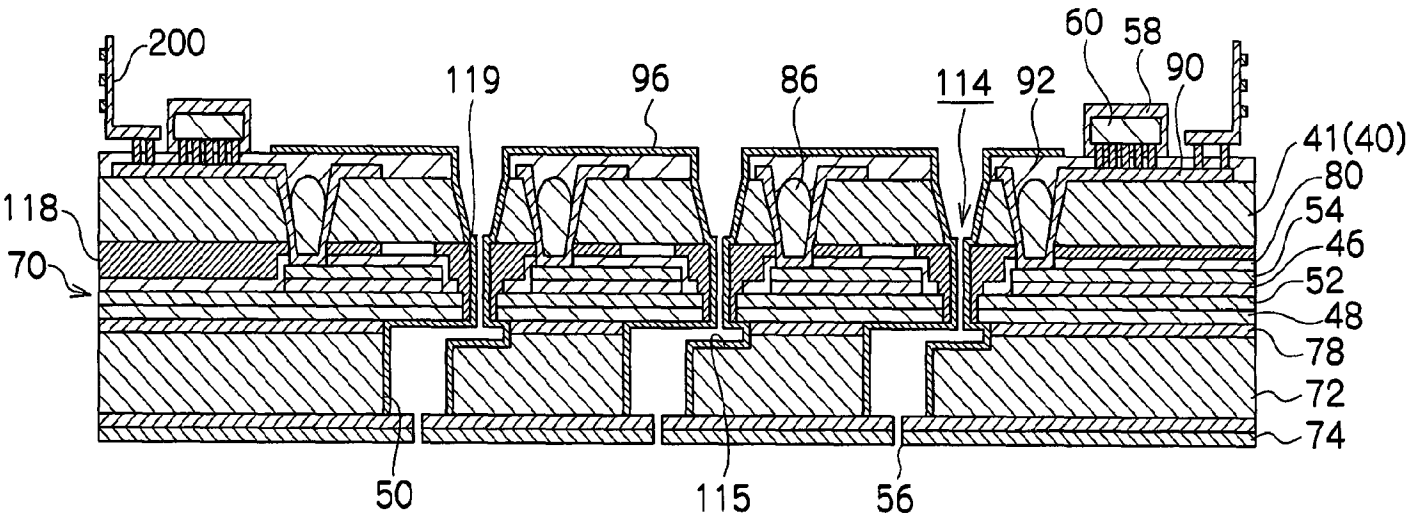

Due to this, in later processes such as dividing the inkjet recording head 32, damage from water or grinding pieces to the completed piezoelectric element substrate 70 caused by dicing can be avoided. Then, as shown in FIG. 12D, the flexible print substrate 200 is connected to the metal wiring 90.

Figure 12E:
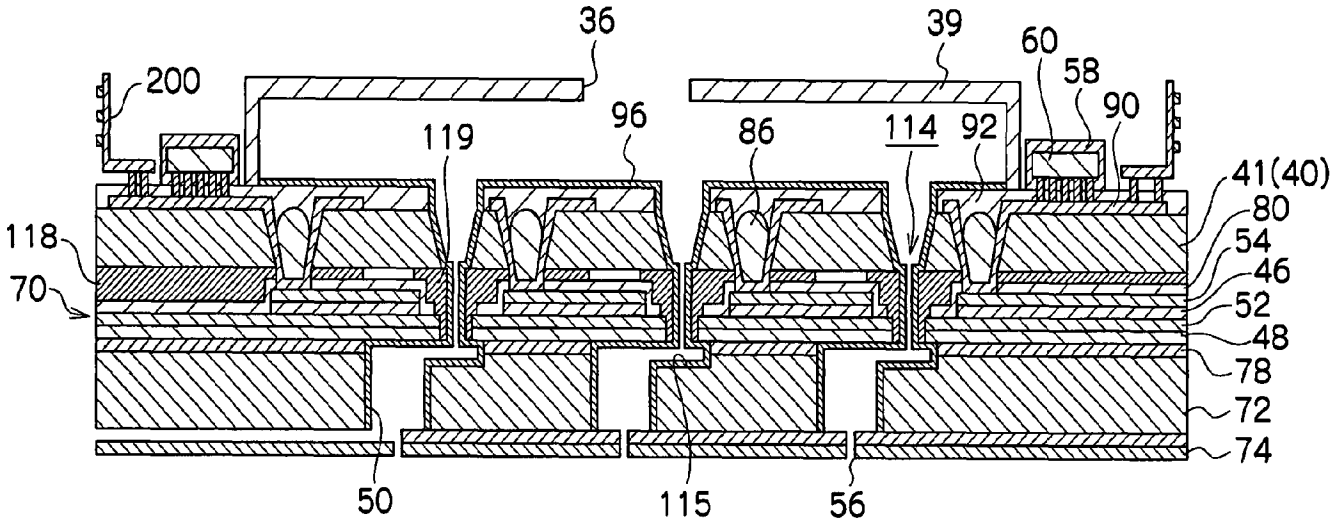
FIGS. 12E-12F are explanatory drawings showing the process after joining the nozzle plate to the piezoelectric element substrate of the first embodiment.
Figure 12F:
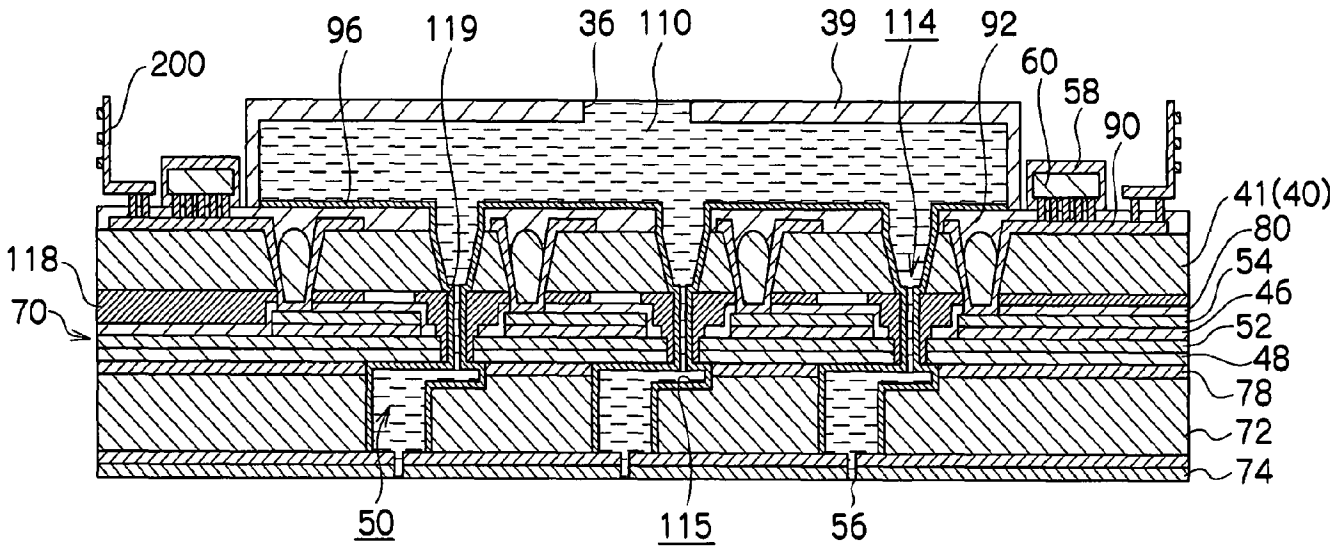

Next, as shown in FIG. 12E, the pool chamber component 39 is attached to the upper surface of the top panel component 40 (top panel 41) further to the inner side than the location of the drive IC 60, and the ink pool chamber 38 is formed between these components. The inkjet recording head 32 is, thus, completed and as shown in FIG. 12F, the ink 110 can be filled into the ink pool chamber 38 and the pressure chamber 115.

The operation of the inkjet recording device 10 provided with the inkjet recording head 32 manufactured as described above will be explained. First, when an electric signal instructing to print is sent to the inkjet recording device 10, one sheet of recording paper P is picked up from the stocker 24 and conveyed with the conveying device 26.

Meanwhile, the ink 110 is already injected (i.e., filled) into the ink pool chamber 38 of the inkjet recording head 32 from the ink tank via an ink supply port. The ink 110 filled in the ink pool chamber 38 is supplied to (i.e., filled into) the pressure chamber 115 through the ink supply route 114. At this time, a slightly indented meniscus into the side of the pressure chamber 115 is formed on the surface of the ink at the end (i.e., the discharge port) of the nozzle 56.

Next, the recording paper P is conveyed while ink droplets are selectively discharged from the multiple nozzles 56, whereby, based on image data, a portion of an image is recorded on the recording paper P. That is, voltage is applied to preset piezoelectric elements 46 at preset timing due to the drive IC 60, the vibration plate 48 is made to flex deform in the up and down directions (i.e., made to oscillate out-of-plane), the ink 110 inside the pressure chamber 115 is pressurized, and ink droplets are discharged from preset nozzles. In this manner, when an image based on image data is completely recorded on the recording paper P, the recording paper P is ejected to the tray 25 with the paper-discharging belt 23. Print processing (i.e., image recording) on the recording paper P is thus completed.

The inkjet recording head 32 has the piezoelectric element 46 (vibration plate 48) arranged between the ink pool chamber 38 and the pressure chamber 115, and the ink pool chamber 38 and pressure chamber 115 are configured such that they do not exist on the same horizontal surface. Accordingly, the pressure chambers 115 are arranged in close proximity to each other and the nozzles 56 are provided in a highly dense arrangement.

Also, the drive IC 60 that apply voltage to the piezoelectric element 46 are configured so as to not protrude towards the exterior side further than the piezoelectric element substrate 70 (i.e., the drive IC 60 are contained inside the inkjet recording head 32). Accordingly, when compared to a case where the drive IC 60 are attached to the external portion of the inkjet recording head 32, the length of the metal wiring 90 connecting between the piezoelectric element 46 and the drive IC 60 can be shortened and due to this, low resistance from the drive IC 60 to the piezoelectric element 46 is achieved.

In other words, the nozzles 56 can be arranged densely, that is, arrangement of the nozzles 56 in a highly dense matrix pattern is realized with a practical resistance value for the wiring, so high-resolution printing is achieved. Further, the drive IC 60 are flip chip mounted on the top panel 41, so highly dense wiring connectivity can be easily achieved and furthermore, the heights of the drive IC 60 can be reduced (i.e., made thinner). Accordingly, the inkjet recording head 32 can be made to be more compact.

Also, the metal wiring 90 of the top panel 41 is covered by the resin protective film 92 so corrosion of the metal wiring 90 by the ink 110 can be prevented. Further, the drive IC 60 and the upper electrode 54 are connected with the metal wiring 90 inside the electric connection through-port 42 formed on the top panel 41, and solder 86 is also filled inside the electric connection through-port 42. The bottom 42B (see FIG. 11B) is thus reinforced.

Accordingly, even if heat stress or mechanical stress acts upon the bottom 42B, the state of contact between the metal wiring 90 and the upper electrode 54 can be maintained with certainty. Also, even if the metal wiring 90 disconnects, the state of conductivity can be ensured with the solder 86. At the back surface of the top panel 41 (i.e., the undersurface), the top panel component 40 is electrically connected with the piezoelectric element substrate 70 without the formation of wiring or bumps. This means that manufacturing is simplified because only one surface (the top surface) of the top panel 41 needs to be processed.

It is also notable that when electrically connecting the metal wiring 90 with the upper electrode 54 with bumps, for example, the joining of these components becomes difficult if there are variations in the heights of the bumps. Nonetheless, with the present embodiment, even if there are variations in the amount of solder 86, any excess solder 86 is contained within the electric connection through-port 42, so a good connection between the top panel component 40 and the piezoelectric element substrate 70 can be obtained. In other words, variations in the amount of solder 86 can be contained within the electric connection through-port 42, so this point simplifies manufacturing even further.

Also, in actual practice, only the metal wiring 90, upper electrode 54, and solder 86 exist at the portions connecting the metal wiring 90 and the upper electrode 54 and these exhibit high resistance to heat. For this reason, manufacturers have more freedom in the selection of processing methods and materials. Further, the silicon substrate 72 is formed to become a support of the piezoelectric element substrate 70 (i.e., the piezoelectric element substrate 70 can be made in a state where it is supported by the silicon substrate 72) so manufacturing of the inkjet recording head 32 is simplified.

Also, the glass paste 76 is embedded with a screen printing method so this can be embedded with certainty even with a deep opening 72A and groove 72B. It should be noted that when the HF solution that etches the glass paste 76 is substituted with a material that will not etch the material that will serve as the vibration plate 48, an etching stopper layer such as the Ge film 78 becomes unnecessary.

Also, as described above, at least the inner wall surfaces that contact the ink 110, that is, the inner wall surfaces of the resin protective film 92, ink supply through-port 112, dividing wall resin layer 119, pressure chamber 115, and connection route 50 have the SiC film 96 (film thickness: 1 μm) uniformly (i.e., continuously) formed thereon including their adjoining portions (i.e., boundary portions) so their resistance to ink is improved. That is, the inner surfaces of these components that form the ink channel and the adhesive at the portions that join these can be protected from the ink 110 due to the coating of the SiC film 96 that exhibits ink-resistance. For this reason, the reliability of the inkjet recording head 32 with regard to ink resistance can be improved.

Further, the SiC film 96 has hydrophilic qualities so bubble-discharging qualities within the ink channel can be improved. A chart comparing the contact angles of the SiC film (film thickness: 1 μm) with other components used in the inkjet recording head 32 is shown in FIG. 14A. 100 degree C. or more was designated as the evaluation standard of water repellency using purified water. Further, a chart comparing the amount of change in the contact angles of SiC film using purified water after the SiC film contacts with ink 110 (with a film thickness of 1 μm, at 70° C. after the passage of 300 hours) is shown in FIG. 14B. For the ink 110, acidic fluids and base fluids were selected from the aqueous materials, and a UV monomer was selected from among lipophilic materials. The environment where measurement took place was a room with a temperature of 24° C. and humidity of 60%. Generally, the lower the angle of contact, the better the wetness and hydrophilic qualities become.

As shown in FIG. 14A, each of the components have their own different contact angles. For example, since the angle of contact of the photosensitive glass is relatively high (with worse wetness qualities) an inkjet recording head 32 in which this photosensitive glass is a structural component is cause for concern with regard to the generation and retention of bubbles. In contrast, with the SiC film 96, which when compared to other components has a low angle of contact, the wetness qualities with respect to the ink 110 inside the channels can be made equal by coating the interior of the channel with the SiC film 96. Further, as shown in FIG. 14B, the SiC film 96 exhibits almost the same contact angle before fluid contact tests with each ink, so it is understood that the SiC film 96 has high resistance to ink regardless of whether the inks are water or oil-based.

Figure 15:
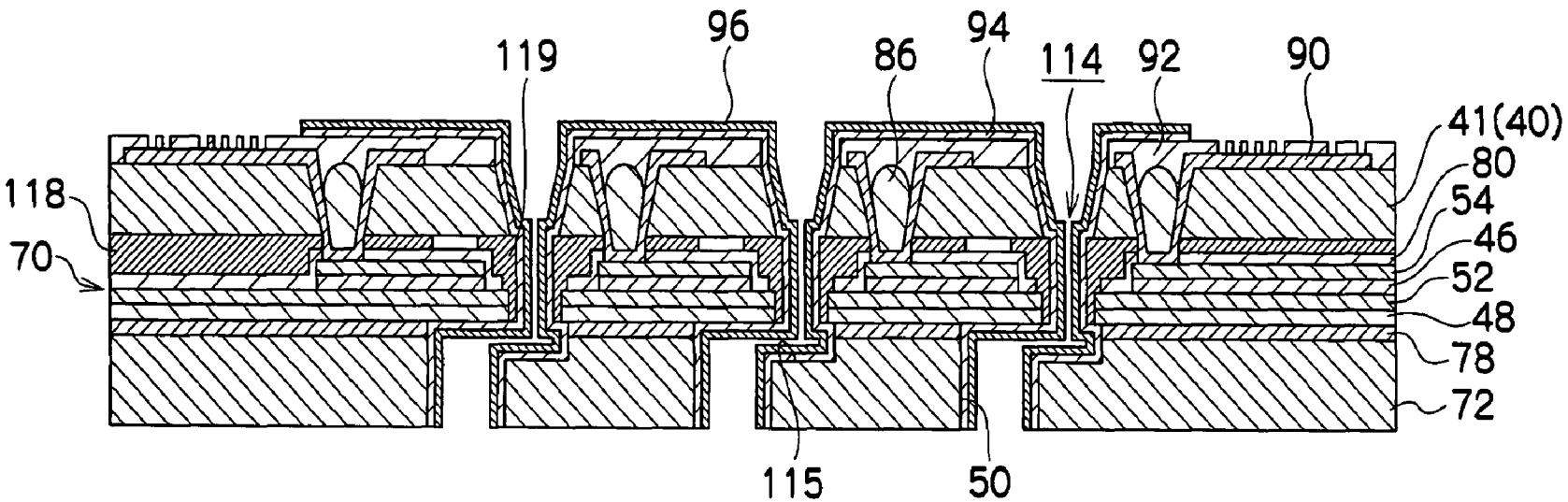
FIG. 15 is an explanatory drawing showing a case where a thin organic film is provided at the inkjet recording head of the first embodiment prior to formation of the SiC film.

Further, as shown in FIG. 15, a thin organic film 94 made from a polymer such as a polyimide can be formed (i.e., coated) as a base prior to formation of the SiC film 96. That is, the thin organic film 94 can be provided so as to uniformly include (i.e., continue with) at least the inner wall surfaces of the resin protective film 92, ink supply through-port 112, dividing wall resin layer 119, pressure chamber 115, and connection route 50 that directly contact the ink 110 and their adjoining portions (i.e., boundary portions).

Each structure of the inkjet recording head 32 is formed from a number of differing materials and the layers of each structure are connected, so there are many changeable (i.e., stress) factors, such as the fact that the thermal expansion coefficients of each of the structural materials are different. If the SiC film 96, which has high hardness relative to each structure, is directly formed thereon, there is a possibility of damage such as cracks occurring in the SiC film 96 due to such stress. However, by forming the SiC film 96 on the highly flexible thin organic film 94, peeling (i.e., deterioration) of the SiC film 96 due to aging can be prevented. That is, with this coating, the film adhesion strength of the SiC film 96 can be improved so the reliability of the inkjet recording head 32 relative to ink resistance can be further improved.

Next, the second embodiment of the inkjet recording head 32 will be explained. It should be noted that structural factors and components and the like that are the same as in the first embodiment have been given the same part numbers and detailed explanations thereon (including on the operation) have been omitted. Further, detailed explanations will be made only on the manufacturing method of the inkjet recording head 32 of the second embodiment that differ from the first embodiment, based on FIGS. 16-21.

Figure 16:
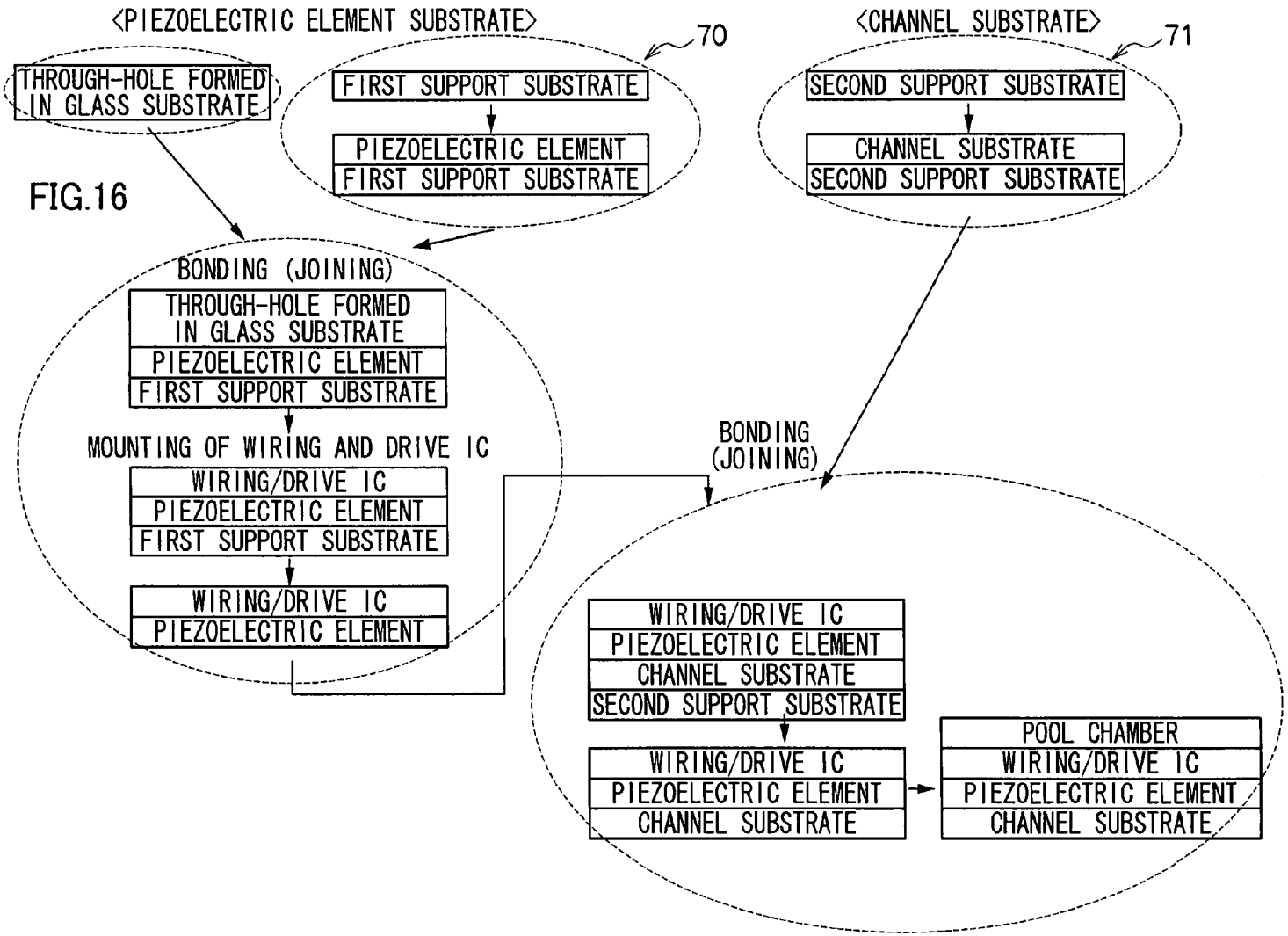
FIG. 16 is an explanatory drawing of the overall process of manufacturing the inkjet recording head of the second embodiment.

As shown in FIG. 16, the manufacturing method for this inkjet recording head 32 involves making the piezoelectric element substrate 70 and a channel substrate 71 separately and then joining (i.e., attaching) them both. Here, explanations will first be made with regard to the manufacturing process of the piezoelectric element substrate 70 where the top panel component 40 is joined (i.e., attached) to the piezoelectric element substrate 70 earlier than the channel substrate 71.

Figures 17A, 17B, 17C, 17D, 17E, 17F:
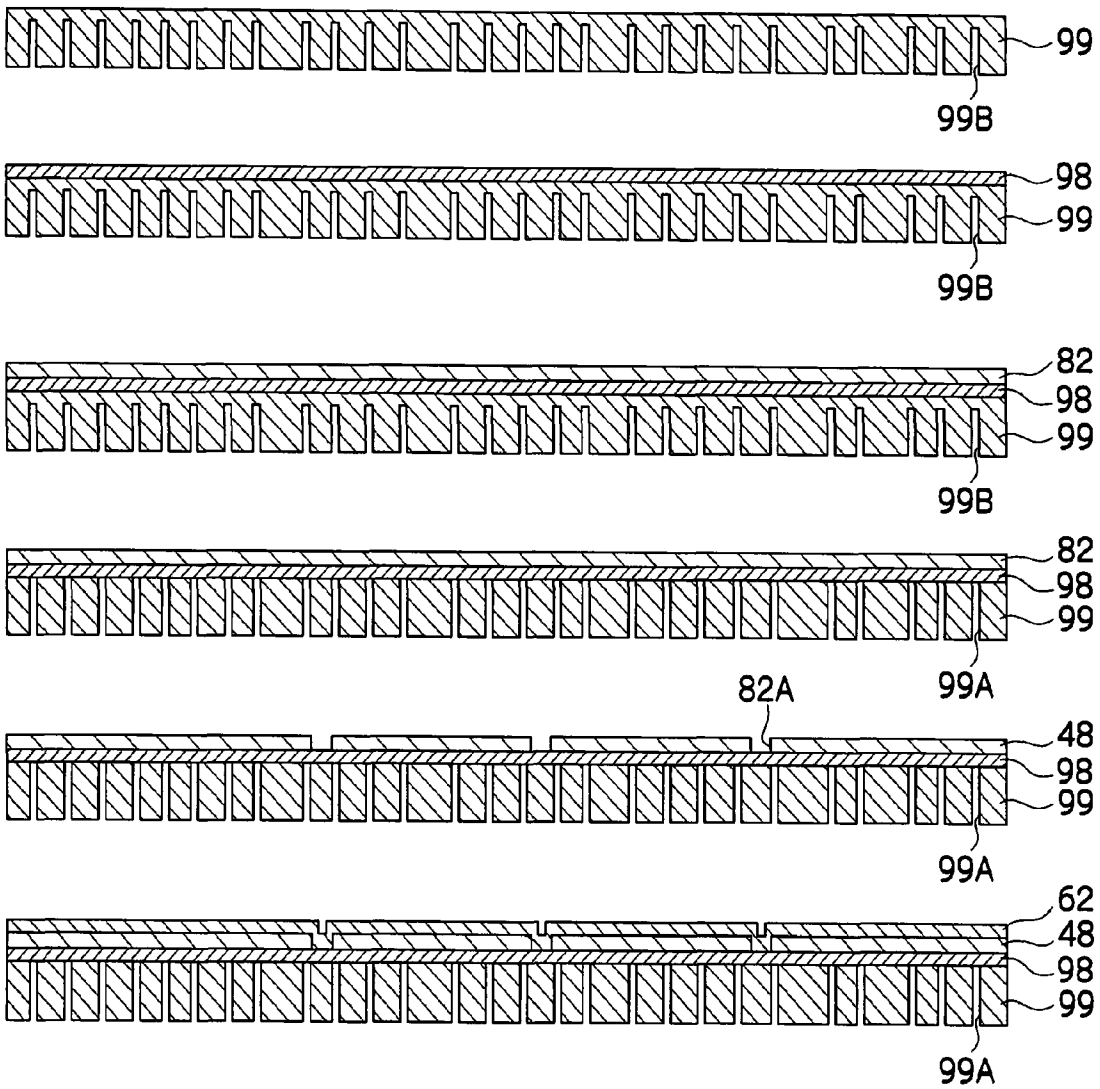
FIGS. 17A-17F are explanatory drawings showing the manufacturing process for the piezoelectric element substrate of the second embodiment.

As shown in FIG. 17A, a first support substrate 99 made of glass is prepared in which multiple non-through holes 99B have been provided. The first support substrate 99 can be made from any material such as various ceramics as long as it does not flex, and although it is not limited to glass, glass is preferable since it is both hard and cheap. With regard to the method of making this first support substrate 99, blast processing of a glass substrate and femtosecond laser processing are known, and others as well as exposing and developing a photosensitive glass substrate (e.g., the PEG3C made by the Hoya Corporation).

Then as shown in FIG. 17B, the Si film 98 (film thickness: 1 μm) is adhered to the upper face (i.e., surface) of the first support substrate 99 with a sputter method. This Si film 98 functions as an adhesive layer and a boundary-peeling layer. The Si film 98 can be formed with a vapor deposition method or a CVD method.

Then, as shown in FIG. 17C, a thin layer that will become the vibration plate 48 is formed on the upper surface of the Si film 98. This is the SiOx film 82 (film thickness: 4 μm) formed using, for example, a plasma CVD method with a temperature of 350° C., an RF power of 300 W, a frequency of 450 KHz, a pressure of 1.5 torr, and with a gas of $SiH_4/N_2O$=150/4000 sccm. The material for the vibration plate 48 in this case can be an SiNx film, SiC film, or a metal film (e.g., Cr) and the like.

Then, as shown in FIG. 17D, the undersurface side of the first support substrate 99 is etched and a through-hole 99A is made through the non-through hole 99B. Specifically, a protective resist (i.e., protective film) is coated on the upper surface of the SiOx film 82 and the undersurface side of the first support substrate 99 is etched with hydrogen fluoride (HF) in a state where the SiOx film 82 is protected, after which the protective resist is peeled off. When using a material in the vibration plate 48 that will not be etched with the etching agent (HF), the protective resist (i.e., protective layer) becomes unnecessary.

Then, as shown in FIG. 17E, the holes 82A for forming the ink supply route 114 are patterned on the SiOx film 82. Specifically, resist formation is performed with a photolithographic method, patterning (i.e., HF etching) is done, and resist peeling is performed with oxygen plasma. Then, as shown in FIG. 17F, the Au film 62, that is, the lower electrode 52, is formed to have a thickness of about 0.5 μm using a sputter method.

Figures 17G, 17H, 17I, 17J, 17K:
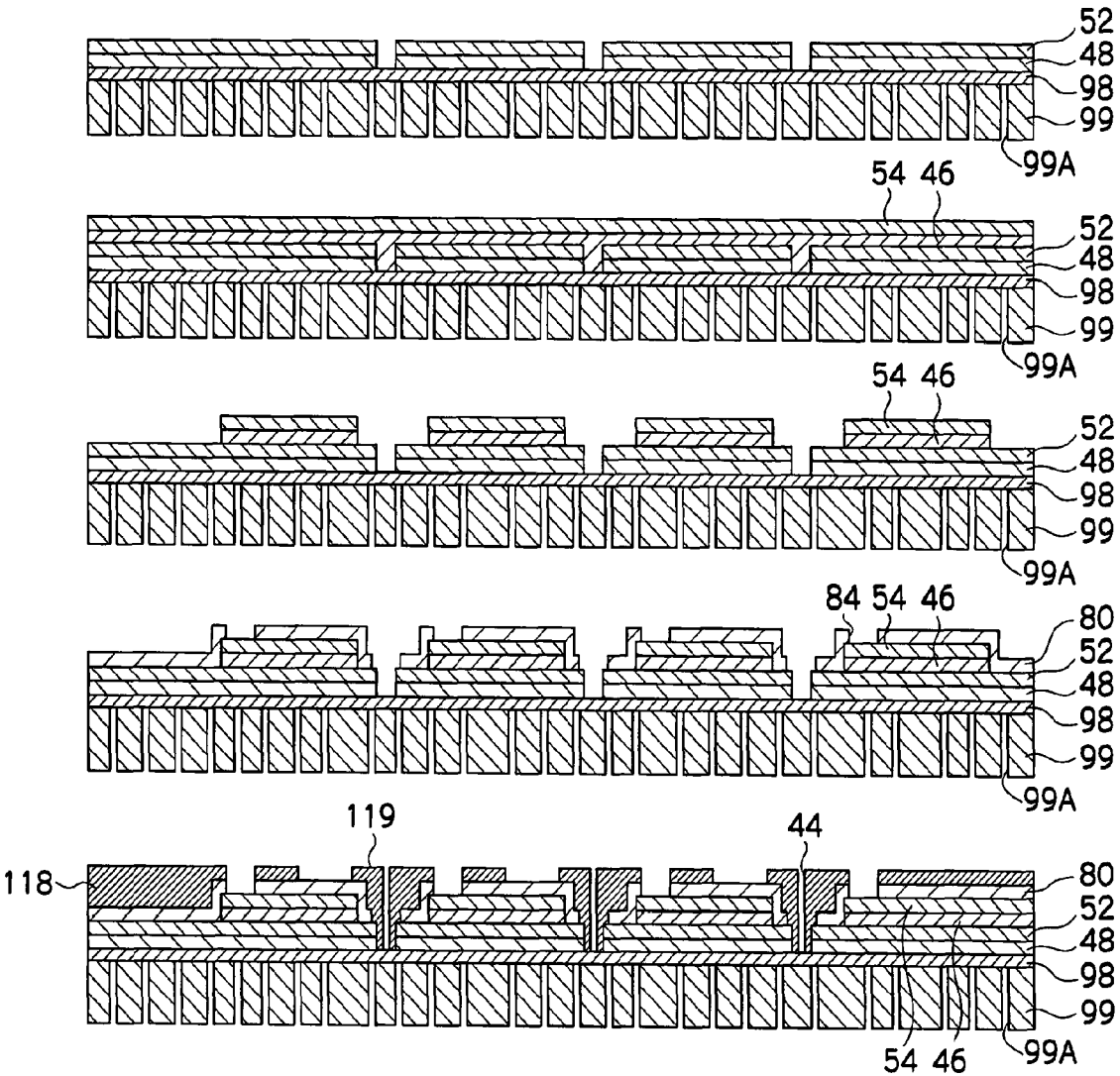
FIGS. 17G-17K are explanatory drawings showing the manufacturing process for the piezoelectric element substrate of the second embodiment.

Next, as shown in FIG. 17G, the lower electrode 52 layered on the upper surface of the vibration plate 48 is patterned. Specifically, resist formation is performed with a photolithographic method, patterning is done, etching is performed with an RIE method, and resist peeling is performed with oxygen plasma. This lower electrode 52 thus becomes the ground potential.

Then, as shown in FIG. 17H, a PZT film that is the material for the piezoelectric element 46 and the upper electrode 54 (Au film) are layered on the upper surface of the lower electrode 52 in this order, and then, as shown in FIG. 17I, the piezoelectric element 46 (PZT film) and upper electrode 54 (Au film) are patterned.

Specifically, resist formation is performed with a PZT film sputter (film thickness: 5 μm), an Au film sputter (film thickness: 0.5 μm) or a photolithographic method, patterning (i.e., etching) is done, and resist peeling is performed with oxygen plasma. Materials that can be used for the upper and lower electrodes include those that are heat-resistant and highly compatible with the PZT material for the piezoelectric element 46, such as Au, Ir, Ru, and Pt.

After that, as shown in FIG. 17J, the SiOx film 80 is layered on the upper surfaces of the lower electrode 52 and upper electrode 54 that are exposed at the upper surface. Then an opening 84 (contact hole) for connecting the upper electrode 54 and the metal wiring 90 is formed with patterning. Specifically, the SiOx film 80, which has a high dangling-bond density, is coated with a CVD method, resist formation is performed with a photolithographic method, patterning (i.e., etching) is done, and resist peeling is performed with oxygen plasma. It should be noted that here, an SiOx film was used as the insulating film having low water-permeability, however, an SiNx film or SiOxNy film can be used.

Next, as shown in FIG. 17K, the dividing wall resin layer 119 and the dividing wall resin layer 118 are patterned. Specifically, a photosensitive resin comprising the dividing wall resin layer 119 and dividing wall resin layer 118 is coated thereon, a pattern is formed by exposure/development, and finally, the structure is cured. At this time, the ink supply through-port 44 is formed in the dividing wall resin layer 119. It is important to note that the dividing wall resin layer 119 and the dividing wall resin layer 118 are the same film, however, their respective design patterns differ.

Figure 18A:
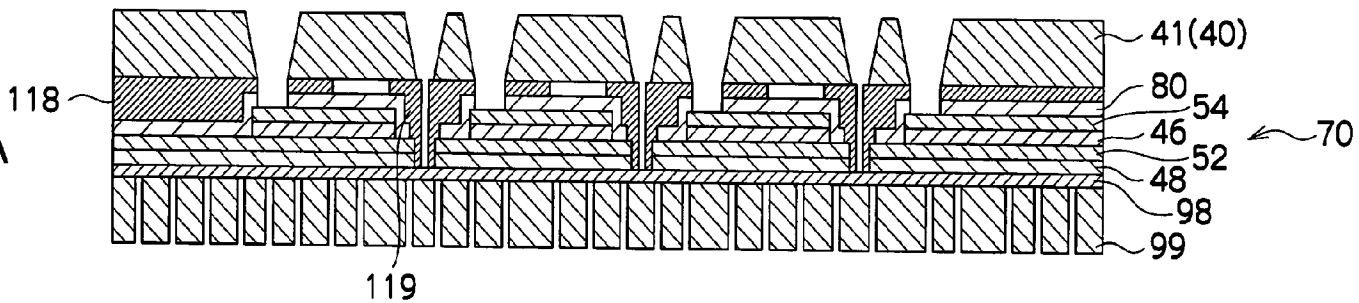
FIGS. 18A-18C are explanatory drawings showing the process after joining the piezoelectric element substrate to the top panel component of the second embodiment.

The piezoelectric element substrate 70 is manufactured and the top panel component 40 that is, for example, a glass board acting as a substrate, is attached (i.e., joined) to the upper surface of this piezoelectric element substrate 70. The manufacturing of the top panel component 40 is the same as in the first embodiment (see FIG. 10). As shown in FIG. 18A, this top panel component 40 (top panel 41) is covered over the piezoelectric element substrate 70 and these components are attached (i.e., joined) together with thermal adhesion (e.g., at 350° C. at 2 kg/cm$^2$ for 20 min.). The dividing wall resin layer 119 and dividing wall resin layer 118 are configured to have a common surface (i.e., they have the same heights) so the dividing wall resin layer 119 and dividing wall resin layer 118 are enhanced to contact and be joined with the top panel 41 with a good seal.

Figure 18B:
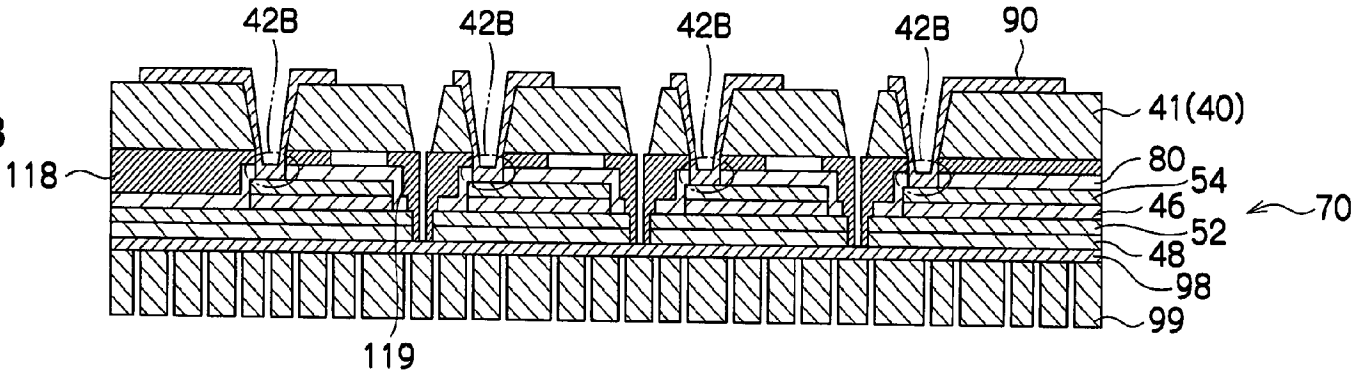

Then, as shown in FIG. 18B, the metal wiring 90 is formed on the upper surface of the top panel 41 and then patterned. Specifically, an A1 film (film thickness: 1 μm) is adhered with a sputter method and a resist is formed with a photolithographic method. A1 film is wet etched with utilizing an $H_3PO_4$ chemical solution, and the resist is peeled with oxygen plasma.

Figure 18C:
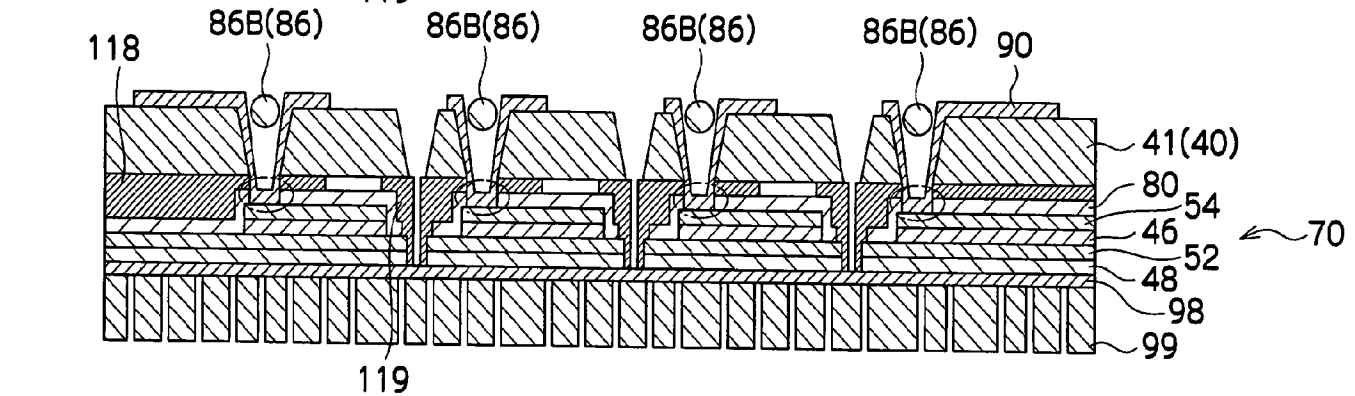

It should be noted that at this time, a portion of the metal wiring 90 is patterned so as to reach the upper electrode 54 from the inner surface of the electric connection through-port 42. Due to this, the bottom 42B of the electric connection through-port 42 is closed off with the metal wiring 90 so the electric connection through-port 42 becomes a closed space except for the upper portion, which is open. Then, as shown in FIG. 18C, the solder 86 is loaded inside of the electric connection through-port 42 (i.e., inside the above-mentioned space). A solder ball method that directly loads the solder ball 86B inside the electric connection through-port 42 can be used for this method.

Figure 18D:
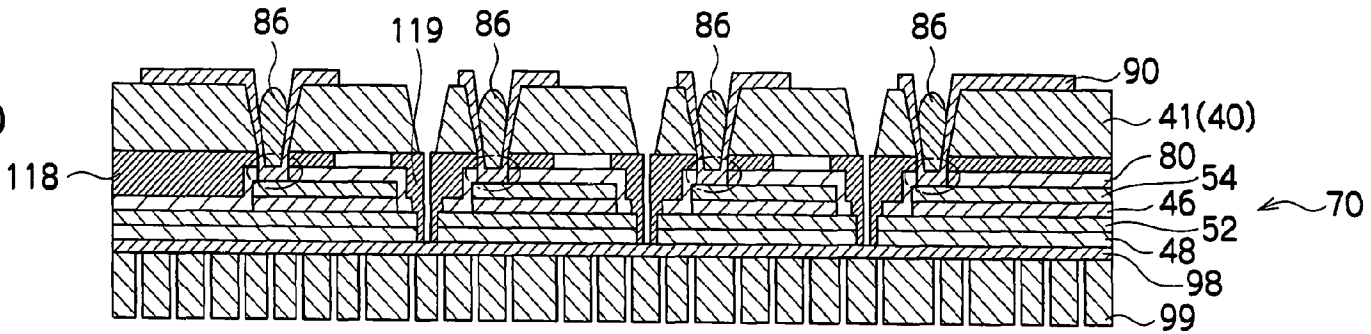
FIGS. 18D-18F are explanatory drawings showing the process after joining the piezoelectric element substrate to the top panel component of the second embodiment.

Next, as shown in FIG. 18D, the solder 86 is re-flowed (e.g., at 280° C. for 10 min.) and made to spread to the bottom 42B of the electric connection through-port 42. At this time, there is no route for the melted solder 86 to flow out at the bottom 42B of the electric connection through-port 42 so the solder 86 can be sufficiently melted in a high-temperature environment and filled up to the bottom 42B of the electric connection through-port 42 with certainty.

Figure 18E:
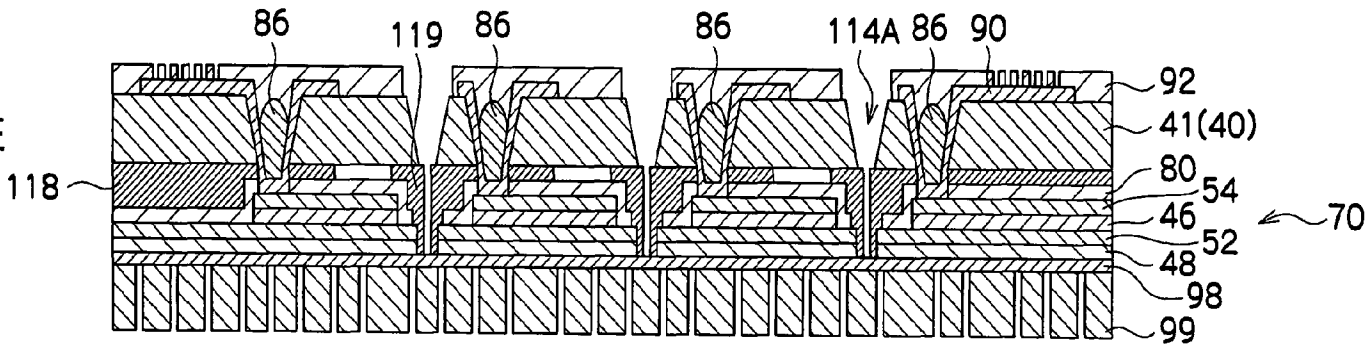

Next, as shown in FIG. 18E, the resin protective film 92 (e.g., the photosensitive polyimide Durimide 7320 made by FUJI FILM Arch Co., Ltd.) is layered on the surface on which the metal wiring 90 is formed and then patterned. At this time, the resin protective film 92 is layered such that it does not cover the first ink supply route 114. The resin protective film 92 can be any material such as a polyimide, polyamide, epoxy, polyurethane, or silicon, as long as it has resistance to ink.

Figure 18F:
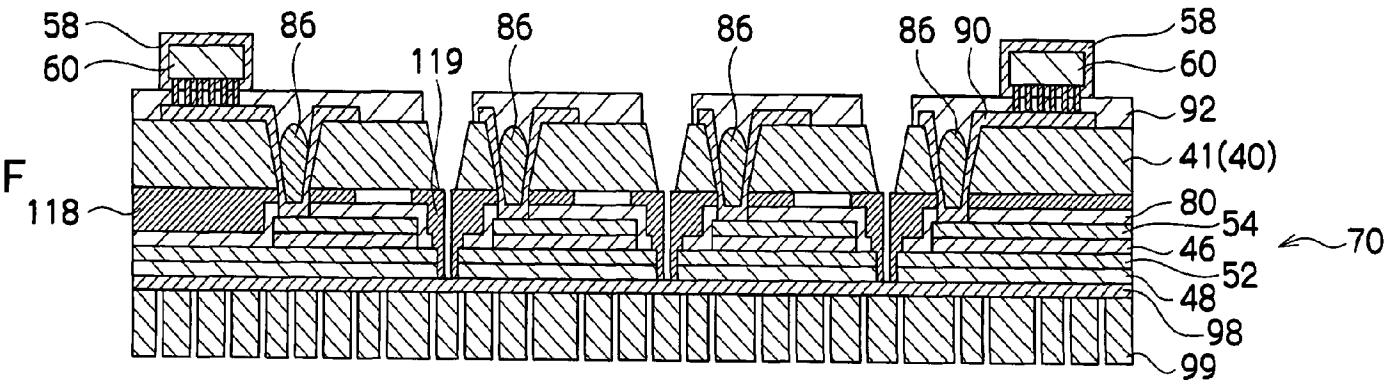

Further, as shown in FIG. 18F, the drive IC 60 is flip chip attached to the metal wiring 90. At this time, the drive IC 60 is processed to a preset thickness (70-300 μm) with grind processing at the end of semiconductor wear processing performed in advance. Then the periphery of the drive IC 60 is sealed with the resin material 58 so that the drive IC 60 can be protected from moisture and the like from the external environment.

Figure 18G:
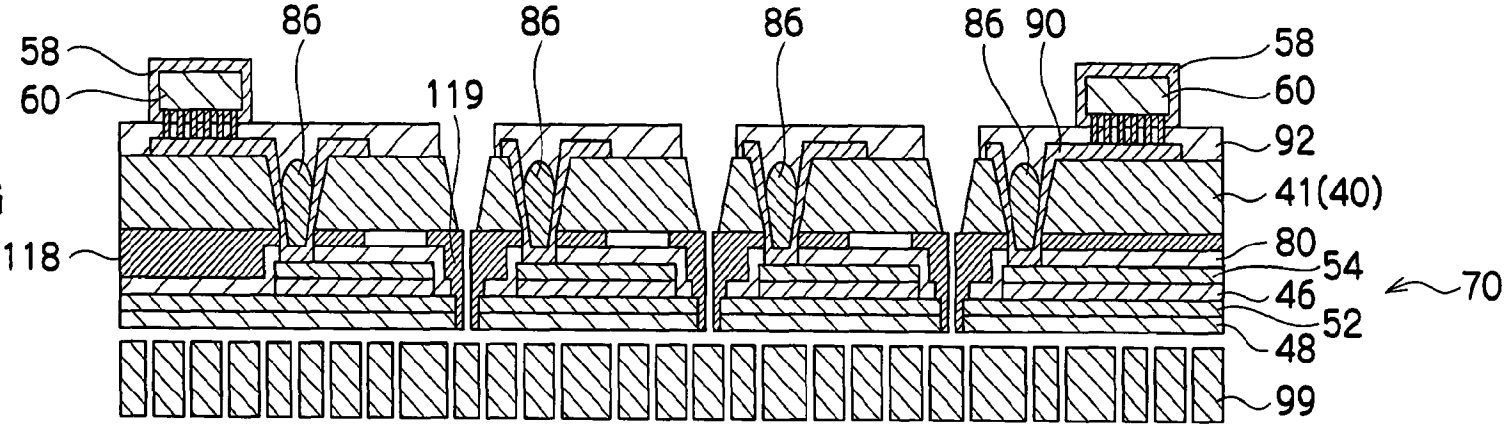
FIGS. 18G-18H are explanatory drawings showing the process after joining the piezoelectric element substrate to the top panel component of the second embodiment.

Due to this, damage caused by water or grinding pieces due to dicing to divide the completed piezoelectric element substrate 70 into the inkjet recording head 32 can be avoided in later processes. Then, as shown in FIG. 18G, the Si film 98 is dry etched and removed with a xenon fluoride ($XeF_2$) gas in a vacuum atmosphere and the first support substrate 99 is peeled processed from piezoelectric element substrate 70.

Figure 18H:
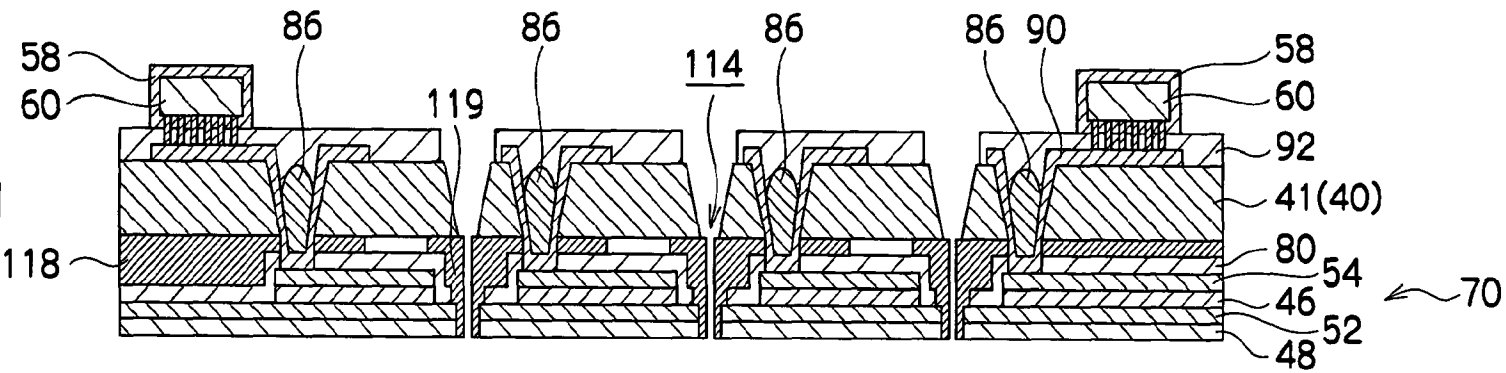
Figure 21:
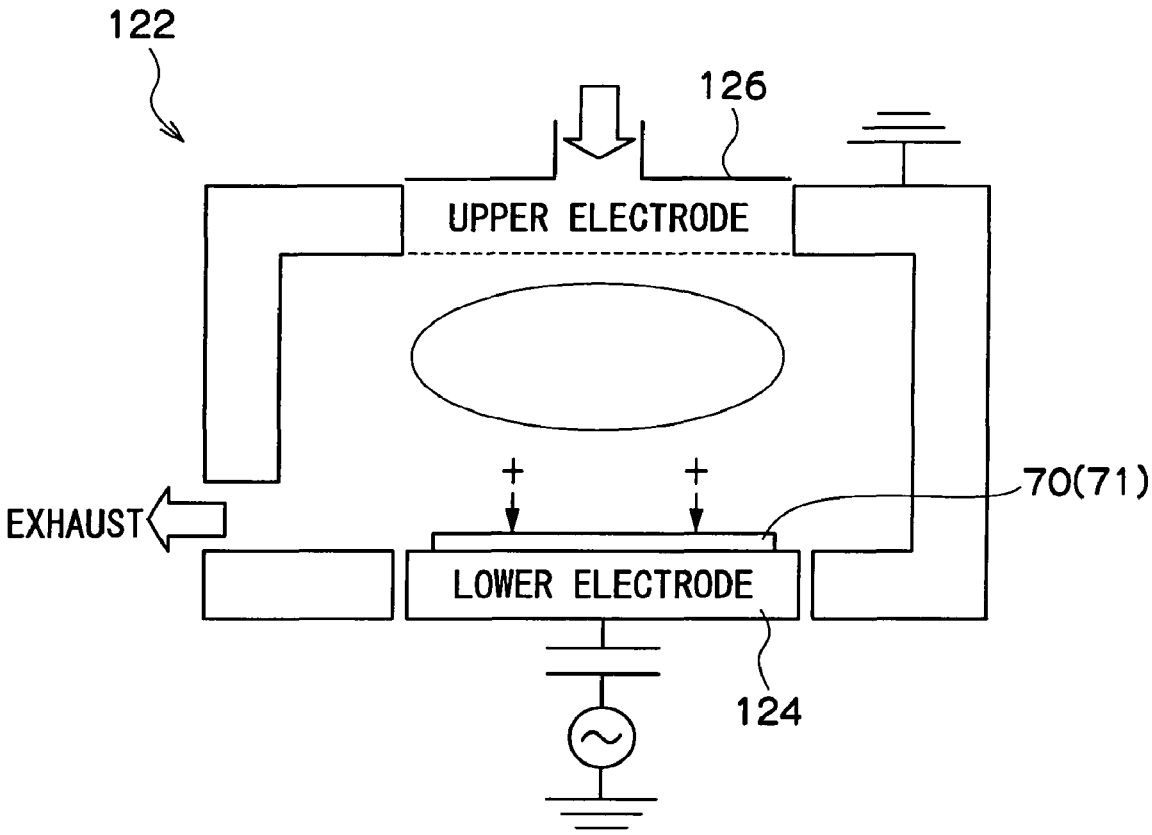
FIG. 21 is an explanatory drawing showing a plasma CVD method device that forms the SiC film.

Then, at least the inner wall surfaces that contact the ink 110, that is, the inner wall surfaces of the resin protective film 92, ink supply through-port 112, and dividing wall resin layer 119 and their adjoining portions (i.e., boundary portions) have the SiC film 96 (film thickness: 1 μm) uniformly formed thereon with a plasma CVD method. That is, the piezoelectric element substrate 70 shown in FIG. 18H is mounted on a lower electrode 124 of a device 122 as shown in FIG. 21, discharged between the upper electrodes 126, whereby the SiC film 96 is continuously formed on the wall surfaces of the piezoelectric element substrate 70 that directly contact with ink 110.

Figure 18I:
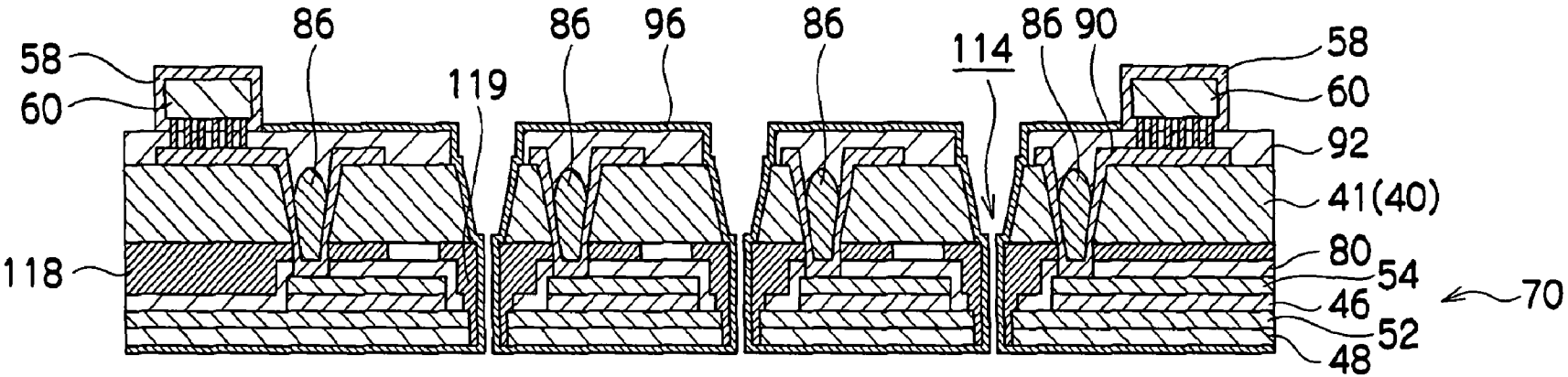
FIG. 18I is an explanatory drawing showing the process after joining the piezoelectric element substrate to the top panel component of the second embodiment.

Prior to formation of the SiC film 96, the thin organic film 94 is formed with an evaporation polymerization method, and as with the first embodiment, the SiC film 96 can be formed thereafter. Evaporation polymerization methods are well-suited for coating elements such as in the present embodiment that have narrow areas because these methods excel in covering stepped structures with a film. Either way, the piezoelectric element substrate 70 to which the top panel component 40 was attached (i.e., joined) is completed due to the formation of the SiC film 96, as shown in FIG. 18I. Then, in this state, the top panel 41 of the top panel component 40 becomes the support body for the piezoelectric element substrate 70.

Figure 19A:
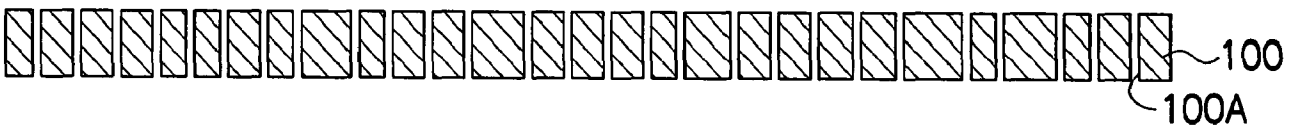
FIGS. 19A-19C are explanatory drawings showing the process of manufacturing the channel substrate of the second embodiment.

Next, the manufacturing process for the channel substrate 71 will be explained. First, as shown in FIG. 19A, a second support substrate 100 made of glass is prepared in which multiple through-holes 100A have been provided. The second support substrate 100 can also be made from any material such as various ceramics, and although it is not limited to glass, glass is preferable in that it is both hard and inexpensive. With regard to the method of making this second support substrate 100, blast processing of a glass substrate and femtosecond laser processing are known, and others as well such as exposing and developing a photosensitive glass substrate (e.g., the PEG3C made by the Hoya Corporation).

Figure 19B:
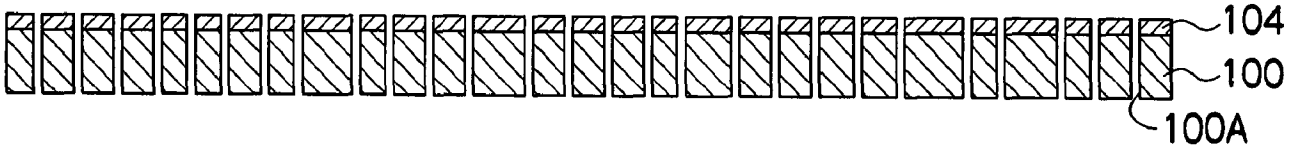
Figure 19C:
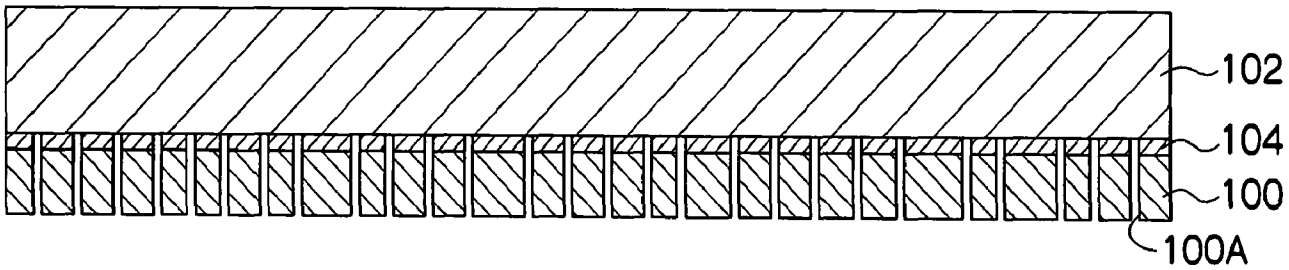
Figure 19D:
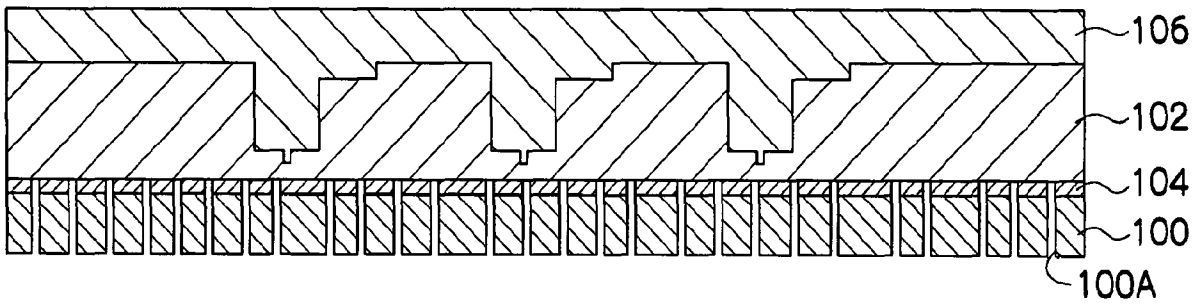
FIGS. 19D-19F are explanatory drawings showing the process of manufacturing the channel substrate of the second embodiment.
Figure 19E:
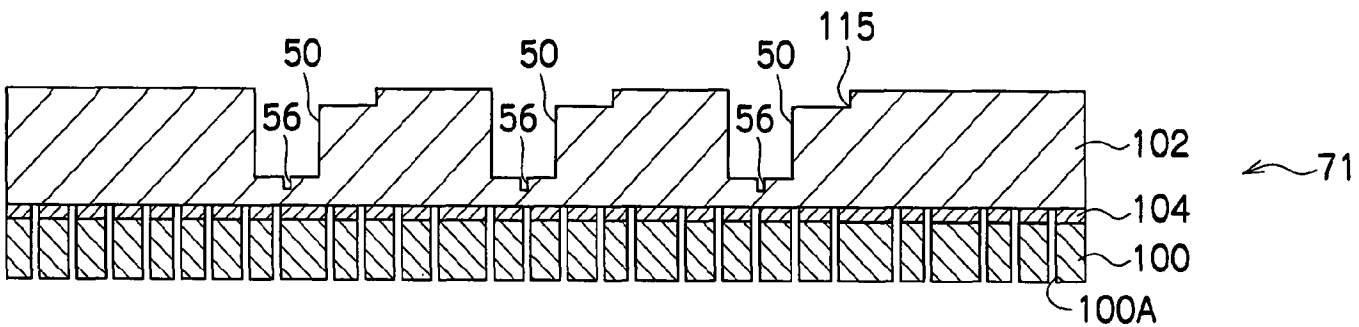

Then, as shown in FIG. 19B, an adhesive 104 is coated on the upper surface of the second support substrate 100 and as shown in FIG. 19C, a resin substrate 102 (e.g., an amide imide substrate with a thickness of 0.1-0.5 mm) is adhered to the upper surface thereof. Then, as shown in FIG. 19D, a metal mold 106 is pressed against the upper surface of the resin substrate 102, and heating/heat-pressure processing is performed. After that, as shown in FIG. 19E, the metal mold 106 is removed from the resin substrate 102.

Figure 19F:
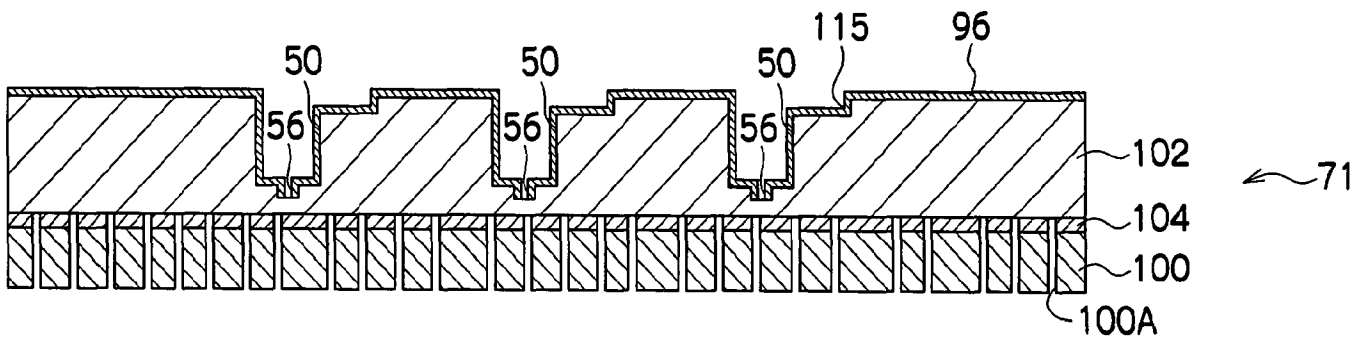

Then, as with the piezoelectric element substrate 70, the channel substrate 71 is mounted on the lower electrode 124 of the device 122 shown in FIG. 21 and discharged between the upper electrodes 126, whereby the SiC film 96 (film thickness: 1 μm) is uniformly formed on at least the inner wall surfaces of the pressure chamber 115 and connection route 50 that contact the ink 110 directly in the channel substrate 71. It should be noted that in this case, the thin organic film 94 can be formed with an evaporation polymerization method prior to the formation of the SiC film 96, after which the SiC film 96 can be formed. In this manner, as shown in FIG. 19F, the channel substrate 71 in which components such as the pressure chamber 115 and nozzles 56 are formed is completed.

The piezoelectric element substrate 70 and channel substrate 71 are joined with thermal adhesion. When joining these components, the piezoelectric element substrate 70 can be sandwiched between, for example, a retaining component (not shown) and the channel substrate 71. The solder 86 is adjusted so as not to be positioned higher than the upper surface of the top panel 41, that is the solder 86 does not protrude from the electric connection through-port 42, so unintended force does not act on areas such as the joined portions, so defects or troubles do not occur at the joined areas.

Figure 20A:
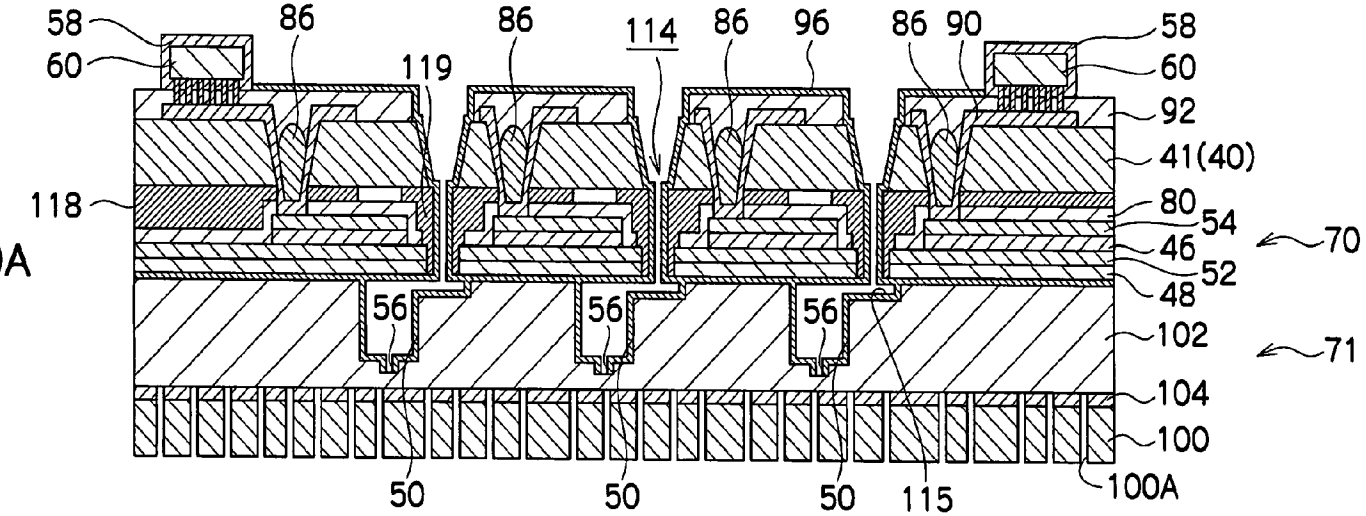
FIGS. 20A-20B are explanatory drawings showing the process after joining the piezoelectric element substrate to the channel substrate of the second embodiment.
Figure 20B:
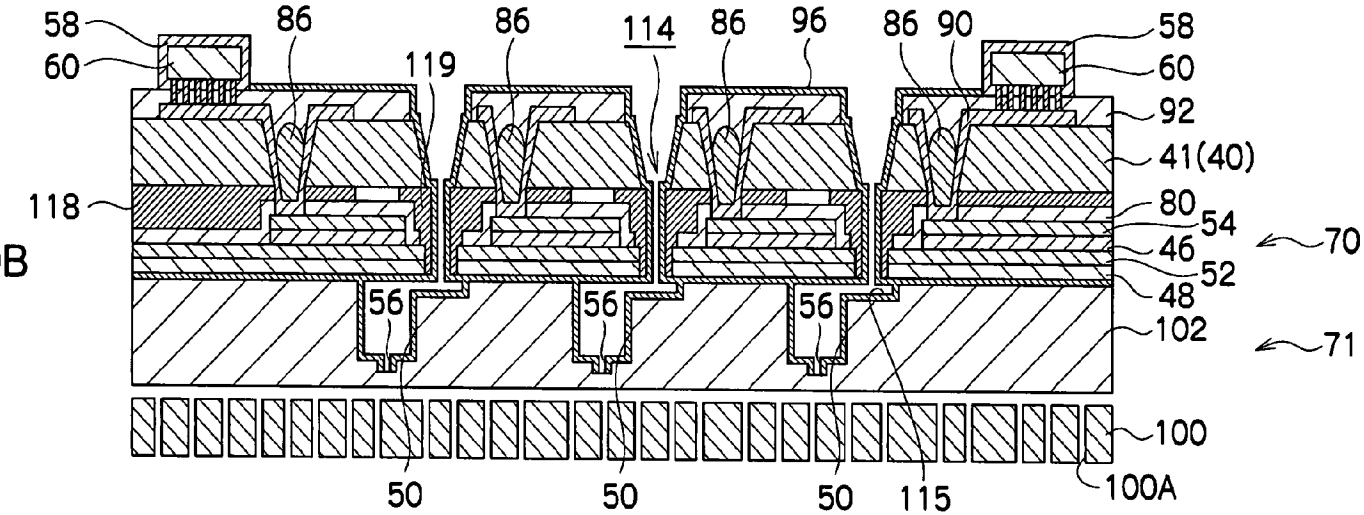
Figure 20C:
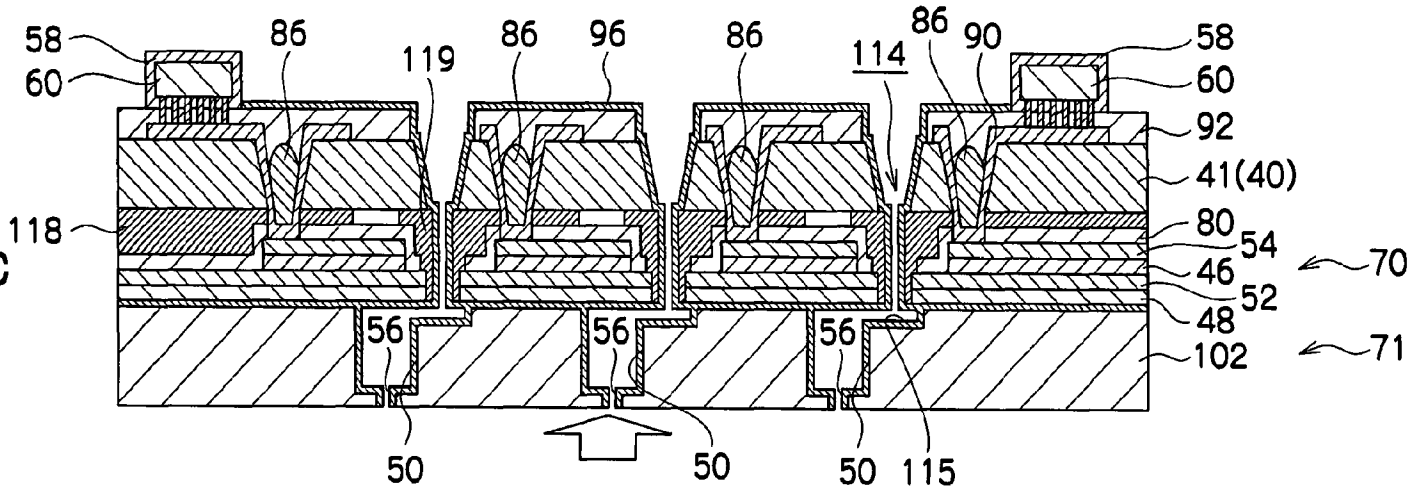
FIGS. 20C-20D are explanatory drawings showing the process after joining the piezoelectric element substrate to the channel substrate of the second embodiment.
Figure 20D:
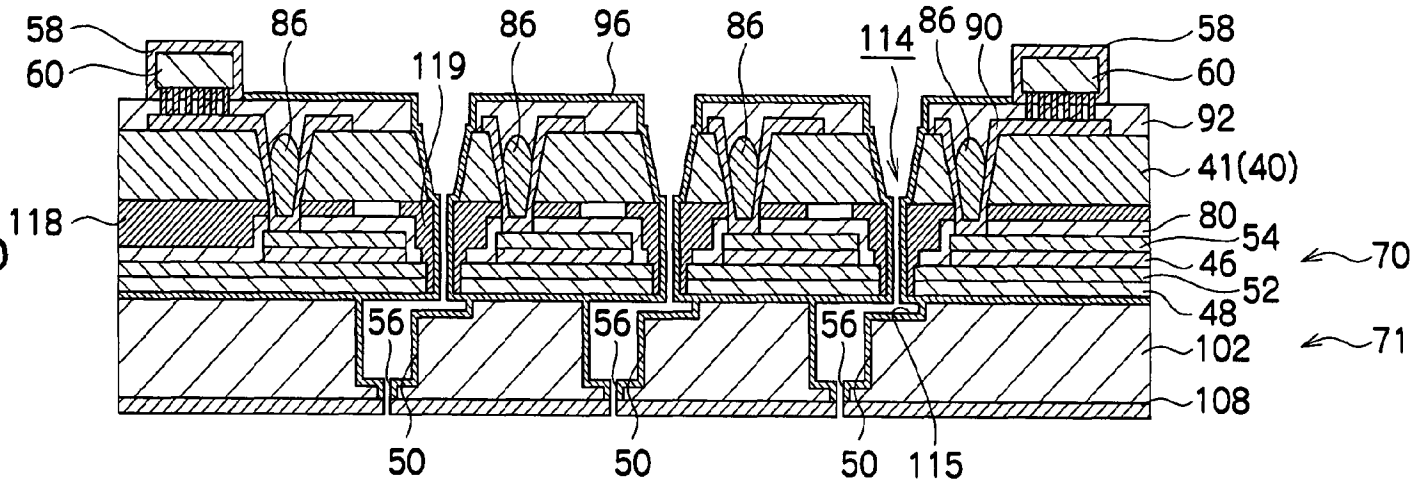

Then, as shown in FIG. 20B, an organic ethanol amine solvent (i.e., an adhesive-peeling solvent) is injected from the through-hole 100A of the second support substrate 100, and peeling processing of the second support substrate 100 from the channel substrate 71 is performed by selectively dissolving the resin adhesive 104. After that, as shown in FIG. 20C, the surface layer from which the second support substrate 100 was peeled is removed with polishing processing using an abradant whose primary material is alumina or with RIE processing using oxygen plasma, and the nozzles 56 are opened. Then, as shown in FIG. 20D, a fluoroelement 108 (e.g., Cytop produced by the Asahi Glass Co., Ltd.) is coated as a water repellent on the bottom surface where the nozzles 56 were opened.

The processes after this are the same as with the first embodiment. That is, the pool chamber component 39 is attached to the upper surface of the top panel component 40 (top panel 41) and the ink pool chamber 38 is configured between these, whereby the inkjet recording head 32 is completed and the ink 110 can be filled into the ink pool chamber 38 and the pressure chamber 115.

As explained above, with the present invention, after the inkjet recording head 32 is almost completely assembled, the inner wall surfaces of each of the components forming the ink channel are coated, including the portions joining each of the components (with adhesive and the like), with the SiC film 96 having high ink-resistance capability. Due to this, even if many layers differing types of components are used to configure the inkjet recording head 32, or even if the joining methods for each of the components are different, they can all be protected from the ink 110. Furthermore, the SiC film 96 possesses high hydrophilic capability so the ability to purge bubbles from within the ink channel can be improved. It should be noted that when nitrogen is included in the raw material gas at the time of manufacture, there are cases where nitrogen is actually contained in the SiC film at between 0-30%. For films that are resistant to fluids, it is preferable that the amount of nitrogen be 10% or less.

Further, when the inkjet recording head 32 is configured from many structures that are made from differing types of components and layered, there are many changeable (i.e., stress) factors, such as the fact that the thermal expansion coefficients of each of the structural materials are different. If the SiC film 96, which has high hardness relative to each structure, is directly formed in the inkjet recording head 32, there is a possibility of damage such as cracks occurring in the SiC film 96 due to such stress. However, by providing the highly flexible thin organic film 94 prior to the formation of the SiC film 96, peeling (i.e., deterioration) of the SiC film 96 caused by aging can be prevented. Accordingly, the inner wall surfaces of each of the components comprising the ink channel and the joined portions of each of the components (e.g., adhesion points) can be protected over time from the ink 110. Due to these factors, the ink resistance of each of the components inside the inkjet recording head 32 can be improved and the reliability of the ink resistance of the inkjet recording head 32 can be improved.

It should be noted that as the droplet discharging head of the present invention, an inkjet recording head 32 was described that discharges ink droplets of each of the colors yellow (Y), magenta (M), cyan (C), and black (K). Also, an inkjet recording device 10 provided with this inkjet recording head 32 was described as the droplet discharging device, however, the droplet discharging head and droplet discharging device are not limited to recording images (including text) on a recording paper P.

In other words, the recording medium is not limited to the recording paper P and the discharged fluid is not limited to the ink 110.

The inkjet recording head 32 of the present invention can be applied to, for example, general fluid-spraying devices used industrially, such as those used when discharging ink onto polymer films and glass when making color filters for displays, or for when discharging solder in a molten state on a substrate when forming bumps for mounting parts. Furthermore, with the inkjet recording device 10 of the above-described embodiments, examples are explained with regard to an FWA, however, the present invention can also be applied to a partial width array (PWA) device that has a main scanning mechanism and a sub-scanning mechanism.

The present invention provides a droplet discharging head in which each of the structures comprising the fluid channel can be protected from the fluid, and in which the reliability of the head's resistance to ink can be improved. The present invention also provides a manufacturing method for this head, and a droplet discharging device provided with this droplet discharging head.

A droplet discharging head of one embodiment of the present invention comprises a pressure chamber where liquid is filled through a channel and nozzles that are connected to the pressure chamber and which discharge the liquid as droplets. At least the wall surfaces that contact the fluid are coated with a carbonized silicon film.

A droplet discharging head of one embodiment of the present invention further comprises a vibration plate that comprises a portion of the pressure chamber; and a piezoelectric element that displaces the vibration plate. The wall surfaces of the droplet discharging device that contact the fluid are coated with a carbonized silicon film.

A droplet discharging device according to one embodiment of the present invention is provided with the droplet discharging head of the present invention. The wall surfaces of the droplet discharging head that contact at least the fluid are coated with a carbonized silicon film.

A method of manufacturing the droplet discharging head according to one embodiment of the present invention, wherein the droplet discharging head comprising; a pressure chamber in which fluid is filled through a channel; a nozzle that is connected to the pressure chamber and which discharges the fluid as a droplet; a channel substrate in which the pressure chamber and the nozzle are formed; a piezoelectric element substrate provided with a vibration plate and a piezoelectric element, the vibration plate comprises a portion of the pressure chamber; and the piezoelectric element displaces the vibration plate; and a support substrate comprising a portion of the channel; wherein a wall surface of the droplet discharging device that contacts the fluid is coated with a carbonized silicon film with a chemical vapor growth method after forming the channel substrate, the piezoelectric element substrate, the support substrate, and the pressure chamber.

In each of the above-described embodiments, a thin organic film can be provided between the wall surfaces and the carbonized silicon film.

What is claimed is:

1. A method of manufacturing a droplet discharging head comprising:

a pressure chamber in which fluid is filled through a channel; and a nozzle that is connected to the pressure chamber and which discharges the fluid as a droplet, wherein an inner wall surface of the droplet discharging device is coated with a carbonized silicon film by a chemical vapor growth method, and a thin organic film is provided on the inner wall surface of the droplet discharging device prior to coating the carbonized silicon film.

2. A method of manufacturing a droplet discharging head comprising:

a pressure chamber in which fluid is filled through a channel;

a nozzle that is connected to the pressure chamber and which discharges the fluid as a droplet;

a channel substrate in which the pressure chamber and the nozzle are formed;

a piezoelectric element substrate provided with a vibration plate and a piezoelectric element, wherein the vibration plate comprises a portion of the pressure chamber, and the piezoelectric element displaces the vibration plate; and a support substrate comprising a portion of the channel;

wherein an inner wall surface of the droplet discharging device is coated with a carbonized silicon film by a chemical vapor growth method after forming the channel substrate in which the pressure chamber is formed, the piezoelectric element substrate, and the support substrate, and a thin organic film is provided on the inner wall surface of the droplet discharging device prior to coating the carbonized silicon film.

3. A method of manufacturing a droplet discharging head, wherein a droplet discharging head comprises:

a pressure chamber in which fluid is filled through a channel;

a nozzle that is connected to the pressure chamber and which discharges the fluid as a droplet;

a vibration plate that comprises a portion of the pressure chamber; and a piezoelectric element that displaces the vibration plate, the manufacturing method comprising:

prior to joining a channel substrate, in which the pressure chamber and nozzle are formed, to a piezoelectric element substrate provided with the vibration plate and piezoelectric element, the piezoelectric element substrate and the channel substrate are coated with a carbonized silicon film by a chemical vapor growth method, and a thin organic film is provided on the piezoelectric element substrate and the channel substrate prior to coating the carbonized silicon film.

* * * * *